US012285126B2

(12) United States Patent
Li

(10) Patent No.: US 12,285,126 B2
(45) Date of Patent: Apr. 29, 2025

(54) STORAGE SHELVING PLATE AND STORAGE SHELVING SYSTEM

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 932 days.

(21) Appl. No.: 17/295,446

(22) PCT Filed: Mar. 23, 2021

(86) PCT No.: PCT/CN2021/082421

§ 371 (c)(1),
(2) Date: May 20, 2021

(87) PCT Pub. No.: WO2022/165941

PCT Pub. Date: Aug. 11, 2022

(65) Prior Publication Data

US 2023/0148283 A1 May 11, 2023

(30) Foreign Application Priority Data

Feb. 5, 2021 (CN) ..... 202110158538.5

(51) Int. Cl.

| | |
|---|---|
| ***A47G 29/08*** | (2006.01) |
| ***A47B 47/00*** | (2006.01) |
| ***A47B 96/02*** | (2006.01) |

(52) U.S. Cl.
CPC ..... *A47G 29/08* (2013.01); *A47B 47/0091* (2013.01); *A47B 96/02* (2013.01)

(58) Field of Classification Search
CPC .. A47G 29/08; A47G 29/087; A47B 47/0091; A47B 96/02; A47B 57/406; A47F 5/0018; A47F 5/01; A47F 5/103
See application file for complete search history.

(56) References Cited

U.S. PATENT DOCUMENTS 118,433 A * 8/1871 Chelsey ..... A47B 96/061 108/152
2,599,607 A * 6/1952 Burrise ..... F25D 25/02 D15/89

(Continued)

FOREIGN PATENT DOCUMENTS

CN 2384536 Y 6/2000
CN 2882457 Y 3/2007

(Continued)

OTHER PUBLICATIONS

International Search Report of PCT/CN2021/082421.
First notice of examination opinions of CA3200506 (Oct. 10, 2024).

*Primary Examiner* — Ko H Chan

(57) ABSTRACT

A storage shelving plate and a storage shelving system. The storage shelving system comprises a storage component which comprises a supporting frame and a net frame. The net frame is disposed on the supporting frame. The storage shelving system further includes a storage shelving plate. The storage shelving plate includes a mounting member, and the storage shelving plate can be disposed on the storage component via the mounting member.

7 Claims, 9 Drawing Sheets

(56) References Cited

U.S. PATENT DOCUMENTS 3,241,334 A * 3/1966 Amore ..... F25D 25/021 62/412
3,554,383 A * 1/1971 Ball ..... F25D 23/067 211/153
3,635,355 A * 1/1972 Kronenberger ..... A47B 96/027 312/351
3,637,085 A * 1/1972 Ball ..... F25D 25/02 211/153
3,998,069 A * 12/1976 Kronenberger ..... F25D 17/045 211/183
4,890,746 A * 1/1990 Trulaske, Sr. ..... A47F 5/01 211/153
5,228,581 A * 7/1993 Palladino ..... F25D 25/02 108/90
5,351,842 A * 10/1994 Remmers ..... A47F 5/08 108/29
5,597,077 A * 1/1997 Hartmann ..... A47F 5/0056 211/183
5,655,740 A 8/1997 Lazarus
5,893,470 A * 4/1999 Peggs ..... A47F 3/0486 211/90.01
5,899,147 A * 5/1999 Clayton ..... A47B 96/028 108/42
6,134,854 A * 10/2000 Stanchfield ..... E04F 11/16 52/480
6,401,945 B1 * 6/2002 Gawel ..... A47F 5/0043 211/183
6,725,785 B2 * 4/2004 Wang ..... A47B 13/08 108/90
7,810,440 B2 * 10/2010 Ward ..... A47F 5/01 108/90
7,946,549 B2 * 5/2011 Forrest ..... A47B 96/06 248/249
8,511,488 B2 * 8/2013 Poisson ..... A47B 96/021 211/183
9,149,119 B2 * 10/2015 Hansel ..... A47B 96/021
9,585,475 B2 * 3/2017 Tines ..... A47B 47/04
2002/0170870 A1 * 11/2002 Callis ..... A47B 96/02 211/183
2006/0011570 A1 * 1/2006 Chen ..... A47F 5/0006 211/183
2006/0180056 A1 * 8/2006 Dorholt ..... A47B 13/086 108/90
2009/0001037 A1 * 1/2009 Wilcock ..... A47B 96/02 211/119.003
2015/0053632 A1 * 2/2015 Brinton, Jr. ..... A47B 61/003 248/225.11

FOREIGN PATENT DOCUMENTS

CN 107568892 A 1/2018
CN 208784313 U 4/2019
JP 2009072415 A 4/2009
TW M266810 U 6/2005

* cited by examiner

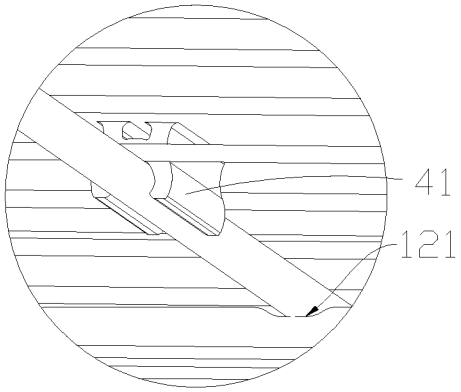
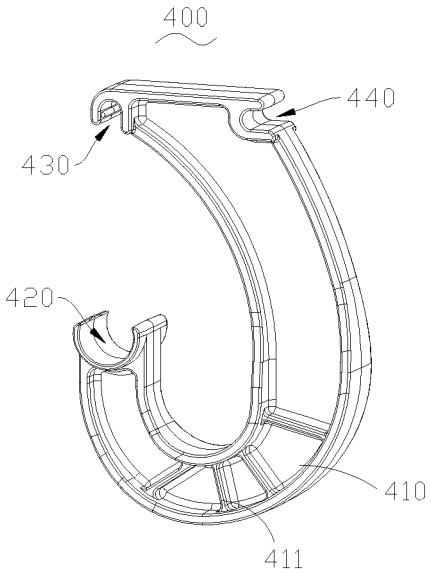
FIG. 13 FIG. 14
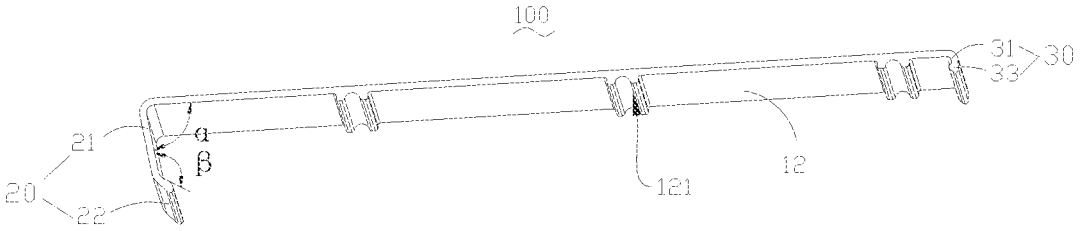
FIG. 15
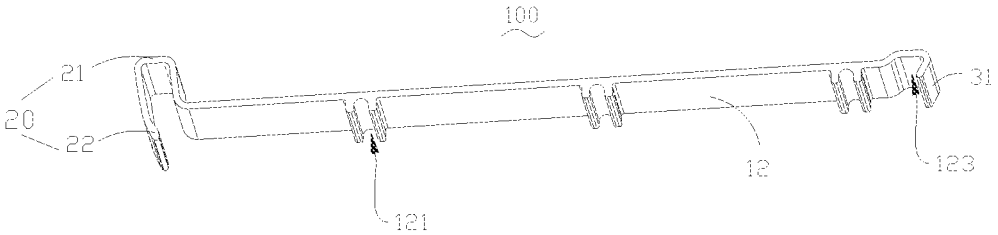
FIG. 16

STORAGE SHELVING PLATE AND STORAGE SHELVING SYSTEM

CROSS-REFERENCE TO RELATED APPLICATIONS

This application is a National Stage application of international application No. PCT/CN2021/082421 filed on Mar. 23, 2021, which claims all benefits accruing under 35 U.S.C. § 119 from China Patent Application No. 202110158538.5, filed on Feb. 5, 2021, and titled "STORAGE SHELVING PLATE AND STORAGE SHELVING SYSTEM" in the China National Intellectual Property Administration, the content of which is hereby incorporated by reference.

TECHNICAL FIELD

The present disclosure relates to a storage shelving system, in particular to a storage shelving plate and a storage shelving system.

BACKGROUND

A net-shaped structure is simply to install and support. Many shelving storage systems use net frames to store objects. However, because the net frame itself has meshes plurality of holes, some smaller objects are likely to fall through the net. Moreover, there are also some objects that can get stuck in the holes, and when the objects are taken out, the net frame may fall off the supporting frame or bracket. In addition, in order to increase a bearing capacity of the net frame, metal materials are generally used. However, metal materials will inevitably have burrs during processing, which can easily scratch the user and cut the net.

SUMMARY

In view of above, it is necessary to provide a storage shelving plate and a storage shelving system.

According to embodiments of the present disclosure, in a first aspect of the present disclosure, a storage shelving system is provided. The storage shelving system includes a storage component which includes a supporting frame and a net frame, and the net frame is disposed on the supporting frame. The storage shelving system further includes a storage shelving plate, the storage shelving plate includes a mounting member, and the storage shelving plate can be disposed on the storage component via the mounting member.

In some embodiments, the storage shelving plate has a first side and a second side separated from each other. The mounting member includes a first mounting member at the first side of the storage shelving plate and/or a second mounting member at the second side of the storage shelving plate. The storage shelving plate is disposed on the storage component via the first mounting member 20 and/or the second mounting member.

In some embodiments, the first mounting member 20 and/or the second mounting member are elastic. The first mounting member 20 and the second mounting member abut against the first side and the second side of the storage shelving plate, respectively. The storage shelving plate matches with the storage component via a pretightening force between the first mounting member and the storage shelving plate and/or between the second mounting member and the storage shelving plate.

In some embodiments, the storage shelving plate includes a plate body. The first mounting member is located at a first side of the plate body which is close to the first side of the storage plate. A first preset angle is defined between the first preset angle and the plate body, and the first mounting member 20 elastically abuts against the storage component.

In some embodiments, the second mounting member is located at a second side of the plate body which is close to the second side of the storage plate, a second preset angle is defined between the second mounting member and the plate body, and the second mounting member elastically abuts against the storage component the storage shelving plate includes a plate body.

In some embodiments, the first mounting member includes a first bending portion fixed to the plate body, and a third preset angle is defined between the first bending portion and the plate body. The first bending portion elastically abuts against the storage component.

In some embodiments, the second mounting member includes a third bending portion fixed to the plate body. A fourth preset angle defined between the third bending portion and the plate body is an acute angle, and the third bending portion abuts against the net frame.

In some embodiments, the second mounting member includes the second bending portion and a fourth bending portion. The second bending portion is fixed to the plate body, and a fifth preset angle is defined by the second bending portion n and the plate body. The fourth bending portion is fixed to the second bending portion and bends towards the first side of the storage shelving plate. The storage shelving plate is fixed to the net frame via the second bending portion n and the fourth bending portion, and the fourth bending portion is configured for preventing the second mounting member from separating from the net frame.

In some embodiments, the second mounting member includes the second bending portion and a second hook portion. The second bending portion is fixed to the plate body and, and a sixth preset angle can be defined between the second bending portion and the plate body. The second hook portion protrudes from the second bending portion and towards the first side of the storage shelving plate, and the second hook portion is configured for preventing the second mounting member from separating from the supporting frame.

In some embodiments, the first mounting member further includes a third bending portion, which is fixed to the first bending portion and bends towards the second side of the storage shelving plate, and the third bending portion is configured for preventing the first mounting member from separating from the storage component.

In some embodiments, the first bending portion bends relative to the plate body and is integrally formed with the plate body. In some embodiments, the first preset angle is an acute angle.

In some embodiments, the third bending portion bends relative to the first bending portion and is integrally formed with the first bending portion.

In some embodiments, the third bending portion is plate-shaped, and an obtuse angle is defined between the first bending portion and the third bending portion.

In some embodiments, the third bending portion is arc-shaped, and the third bending portion protrudes towards the second side of the storage shelving plate.

In some embodiments, the net frame has a loading plane. The net frame bends at one side of the loading plane to form a laterally bending plane, and a seventh preset angle is defined between the laterally bending plane and the loading plane. At least a part of the laterally bending plane abuts against the first bending portion, and the third bending portion is configured for preventing the storage shelving plate from separating from the net frame.

In some embodiments, the laterally bending plane of the net frame bends towards a side away from the supporting fame. A cross section of the first bending portion is U-shaped, and the laterally bending plane is disposed in the first bending portion.

In some embodiments, the storage shelving plate mounting member includes a plurality of second mounting members, and the plurality of second mounting members abut against the net frame, respectively.

In some embodiments, the supporting frame has a first side and a second side. The first side of the supporting frame is close to the first side of the storage shelving system, the second side of the supporting frame is close to the second side of the storage shelving system. A first hook portion is fixed to the second side of the supporting frame, and the first hook portion extends away from the first side of the supporting frame. The second mounting member is elastic, and the second mounting member abuts against the first hook portion via the second hook portion. In some embodiments, the supporting frame includes a frame body and a clipping member, and the clipping member is fixed to the frame body, the clipping member includes a fourth hook portion which is elastic, the net frame is disposed on the supporting frame via the fourth hook portion, and the second mounting member abuts against the second hook portion via the fourth hook portion.

In some embodiments, the net frame includes a first set of rods and a second set of rods. An eighth preset angle is defined between the first set of rods and the second set of rods. The first set of rods and the second set of rods form a net-shaped structure. The storage shelving plate includes a third mounting member. The storage shelving plate is disposed to the net frame via matching between the third mounting member and the first set of rods and/or matching between the third mounting member and the second set of rods.

In some embodiments, the third mounting member includes a plurality of elastic clamping members which are configured for clamping the first set of rods and/or the second set of rods, so that the storage shelving plate is disposed to the net frame.

In some embodiments, the third mounting member includes a locating member, and a mounting groove disposed on the locating member. The storage shelving system further includes a fixing member which is detachably fixed to the mounting groove and storage shelving plate configured for fixing the net frame.

In a second aspect of the present disclosure, a storage shelving system is provided. The storage shelving system includes a supporting frame and a storage shelving plate. The storage shelving plate includes a mounting member, and the storage shelving plate can be fixed to the supporting frame via the mounting member.

In some embodiments, the supporting frame includes a first mounting position and a second mounting position separated from each other, and the mounting member storage shelving plate includes a first mounting member and/or a second mounting member. The first mounting member and the second mounting member are disposed in the first mounting position and the second mounting position, respectively. The storage shelving plate is fixed to the supporting frame via the first mounting member and/or the second mounting member.

In some embodiments, the first mounting member 20 and/or the second mounting member are elastic, and the storage shelving plate matches with the supporting frame via a pretightening force between the first mounting member and the storage shelving plate and/or between the second mounting member and the storage shelving plate.

In some embodiments, the storage shelving plate includes a plate body. The first mounting member has a first bending portion fixed to the plate body and a ninth preset angle can be defined between the first bending portion and the plate body. The first mounting position is disposed at an end of the supporting frame, and the first bending portion elastically abuts against the end of the supporting frame.

In some embodiments, the storage shelving plate includes the plate body. A first hook portion protrudes from the supporting frame and defines the second mounting position. The first hook portion extends away from the first mounting position. The second mounting member includes a second bending portion and a second hook portion. The second bending portion is fixed to the plate body, and a tenth preset angle can be defined between the second bending portion and the plate body. The second hook portion protrudes from the second bending portion towards the first mounting position, and the second hook is configured for preventing the second mounting member from separating from the supporting frame.

In some embodiments, the first mounting member further includes a third bending portion. The third bending portion is fixed to the first bending portion and bends towards the second mounting member. The third bending portion is configured for preventing the first mounting member from separating from the first mounting position.

In some embodiments, a second accommodating groove is disposed on the supporting frame, and the second accommodating groove is configured for fixing the net frame. An inner wall of the second accommodating groove protrudes outwards and defines a third hook portion, and the third hook portion is configured for preventing the wire from separating from the second accommodating groove.

In some embodiments, the supporting frame further includes a clipping member, and the clipping member includes a fourth hook portion. The fourth hook portion is elastic, and the second mounting member abuts against the second hook portion via the fourth hook portion.

In some embodiments, the first bending portion bends relative to the plate body and is integrally formed with the plate body.

In some embodiments, the ninth preset angle is an acute angle.

In some embodiments, the third bending portion bends relative to the first bending portion and is integrally formed with the first bending portion.

In some embodiments, an angle between the third bending portion and the first bending portion is an obtuse angle.

In some embodiments, the third bending portion is arc-shaped, and the third bending portion protrudes towards the second mounting member.

In a third aspect of the present disclosure, a storage shelving system is provided. The storage shelving system includes a storage shelving plate which includes a mounting member, and the storage shelving plate is fixed to the net frame via the mounting member.

In some embodiments, the net frame includes a third mounting position and a fourth mounting position separated from each other. The storage shelving plate mounting member includes a first mounting member and/or a second mounting member. The first mounting member and the second mounting member are disposed on the third mounting position and the fourth mounting position, respectively. The storage shelving plate is disposed on the net frame via the first mounting member and/or the second mounting member.

In some embodiments, the first mounting member 20 and/or the second mounting member are elastic, and the storage shelving plate matches with the net frame via a pretightening force between the first mounting member and the storage shelving plate and/or between the second mounting member and the storage shelving plate.

In some embodiment, the net frame has a loading plane. The net frame bends at one side of the loading plane to form a laterally bending plane, and an eleventh preset angle is defined between the laterally bending plane and the loading plane.

In some embodiments, the laterally bending plate bends towards a side away from a supporting surface 11 of the storage shelving plate. The storage shelving plate includes a plate body. The first mounting member 20 includes a first bending portion and a third bending portion. The first bending portion is fixed to the plate body. A twelfth preset angle is defined between the first bending portion and the plate body. The third bending portion is fixed to the first bending portion and bends towards the fourth mounting position. The sthird bending portion is configured for preventing the first mounting member from separating from the third mounting position.

In some embodiments, a third rod is disposed at the fourth mounting position of the net frame. The storage shelving plate includes the plate body. The second mounting member includes a second bending portion fixed to the plate body and defines a thirteenth present angle with the plate body. A thirteenth present angle is defined between the second bending portion and the plate body is an acute angle, and the second bending portion elastically abuts against the third rod.

In some embodiments, a right angle or an acute angle is defined between the laterally bending plane and the lading plane.

In some embodiments, the third bending portion is plate-shaped, and an obtuse angle is defined between first bending portion and the third bending portion; and/or, In some embodiments, the third bending portion is arc-shaped, and the third bending portion protrudes towards the fourth mounting position.

In some embodiments, the laterally bending plane bends towards a side near the storage shelving plate. The storage shelving plate includes the plate body. The first mounting member includes the first bending portion. A cross section of the first bending portion is U-shaped, and the laterally bending plane is disposed in the first bending portion.

In some embodiments, the storage shelving plate includes the plate body. The second mounting member includes the second bending portion and a fourth bending portion. The second bending portion is fixed to the plate body. A fourteenth preset angle is defined between the second bending portion and the plate body. The fourth bending portion is fixed to the third bending portionsecond bending portion and bends towards the third mounting position. The storage shelving plate is disposed on the net frame via the second bending portion and the fourth bending portion, and the fourth bending portion is configured for preventing the second mounting member from separating from the net frame.

In some embodiments, a third rod is disposed at the fourth mounting position of the net frame; the fourth bending portion is arc-shaped, and a radius of the arc of the fourth bending portion matches with that of a periphery of the third rod.

In some embodiments, the mounting member includes a plurality of second mounting members. The plurality of second mounting members elastically abuts against the third rod, respectively.

In some embodiments, the net frame includes a first set of rods and a second set of rods. A fifteenth preset angle is defined between the first set of rods and the second set of rods, the first set of rods and the second set of rods form a net-shaped structure. The storage shelving plate mounting member includes a third mounting member, and the storage shelving plate is disposed to the net frame via matching between the third mounting member and the first set of rods and/or the second set of rods.

In some embodiments, the third mounting member includes a plurality of elastic clamping members configured for clamping the first set of rods and/or the second set of rods, resulting in the storage shelving plate being fixed to the net frame.

In some embodiments, the storage shelving system further includes a fixing member detachably fixed to the third mounting member, and the storage shelving plate is fixed to the net frame via the fixing member.

In some embodiments, the third mounting member includes a locating member, and a mounting groove is disposed on the locating member. The fixing member includes a fixing portion having a rotating curved surface and a stopper, the fixing portion is able to rotate in the mounting groove via the rotating curved surface, and limit a rotation angle of the fixing portion via the stopper, resulting in the fixing portion being disposed in the mounting groove.

In some embodiments, the mounting groove is a trapezoid-shaped groove, and an inner diameter of the mounting groove gradually increases along a direction towards the net frame. The fixing portion has two rotating curved surfaces and two stoppers. The two rotating curved surfaces and the two limiting angles are staggered disposed. The two rotating curved surfaces can contact simultaneously with or separate simultaneously from an inner wall of the mounting groove, and the two limiting angles are able to contact simultaneously with or separate simultaneously from the inner wall of the mounting groove.

In some embodiments, a first groove is disposed on the fixing portion, a periphery wall of the first groove is regarded as the rotating curved surface and the stopper are located on the rotating curved surface, and the fixing portion forms an interference fit with the mounting groove.

In some embodiments, the fixing portion further includes a swirling portion, and the swirling portion is able to drive the fixing portion to rotate.

In a fourth aspect of the present disclosure, a storage shelving plate is provided. The storage shelving plate includes a plate body and a mounting member fixed to the plate body, and the storage shelving plate is disposed on an external structure via the mounting member.

In some embodiments, the mounting member is elastic, and the storage shelving plate tightly fits with the external structure via the elastic mounting member.

In some embodiments, the mounting member includes a first mounting member and/or a second mounting member. The first mounting member and the second mounting member are located at two sides of the plate body, respectively. The first mounting member and/or the second mounting member are elastic, and the storage shelving plate matches with the external structure via a pretightening force between the first mounting member and the storage shelving plate and/or between the second mounting member and the storage shelving plate.

In some embodiments, the first mounting member includes a first bending portion fixed to the plate body. A sixteenth preset angle is defined between the first bending portion and the plate body; and the first bending portion elastically abuts against the external structure.

In some embodiments, the first mounting member further includes a third bending portion. The third bending portion is fixed to the first bending portion and bends towards the second mounting member. The third bending portion is configured for preventing the first mounting member from separating from the external structure.

In some embodiments, the sixteenth preset angle is an acute angle.

In some embodiments, a cross section of the first bending portion is U-shaped, and the first bending portion is configured for disposing and locating the external structure.

In some embodiments, the third bending portion is plane-shaped, an obtuse angle or a right angle is defined between the third bending portion and the first bending portion.

In some embodiments, the third bending portion is arc-shaped, and the third bending portion protrudes towards the second mounting member.

In some embodiments, the first bending portion bends relative to the plate body, and is integrally formed with the plate body.

In some embodiments, the third bending portion bends relative to the first bending portion and is integrally formed with the first bending portion.

In some embodiments, the second mounting member includes a second bending portion, and the second bending portion is fixed to the plate body. And a seventeenth preset angle can be defined between the second bending portion and the plate body. The second bending portion elastically abuts against the external structure.

In some embodiments, the second mounting member includes the second bending portion and a fourth bending portion. The second bending portion is fixed to the plate body. An eighteenth preset angle is defined between the second bending portion and the plate body. The fourth bending portion is fixed to the second bending portion and bends relative to the second bending portion. The storage shelving plate is disposed to the external structure via the second bending portion and the fourth bending portion, and the fourth bending portion is configured for preventing the second mounting member from separating form the external structure.

In some embodiments, the fourth bending portion is arc-shaped, and a radius of the arc of the fourth bending portion matches with the external structure.

In some embodiments, the mounting member includes a plurality of second mounting members, and the plurality of second mounting members elastically abut against the external structure, respectively.

In some embodiments, the second mounting member includes the second bending portion and a second hook portion. The second bending portion is fixed to the plate body and defines a nineteenth preset angle with the plate body. The second hook portion protrudes towards the first mounting member from the second bending portion, and the second hook portion is configured for preventing the second mounting member from separating from the external structure.

In some embodiments, the mounting member includes a third mounting member disposed on the plate body, and the third mounting member includes a plurality of elastic clamping members, and the plurality of clamping members are able to be disposed on the external structure.

In some embodiments, the third mounting member includes a locating member. A mounting groove is disposed on the locating member, and the locating groove can match with the fixing member, resulting in that the storage shelving plate is detachably disposed on the external structure.

In some embodiments, an opening of the mounting groove is in a trapezoid shaped, and an inner diameter of the mounting groove gradually increases outwards.

In some embodiments, storage shelving plate the mounting member and the plate body are integrally formed.

In some embodiments, the storage shelving plate is made by extrusion molding or injection molding.

In some embodiments, the plate body includes at least two layers. Adjacent two layers are fixed and connected by a connecting rib, and the connecting rib is sheet-shaped, honeycomb-shaped or ripple-shaped.

In some embodiments, the storage shelving plate includes a reserved structure, and the reserved structure is configured for avoiding the external structure.

In some embodiments, the storage shelving plate further includes a conjunction portion, and the two storage shelving plate s are fixed and connected via the conjunction portion therebetween.

In some embodiments, the conjunction portion includes a tenon portion and a blind mortise portion. The tenon portion and the blind mortise portion are located at two sides of the storage shelving plate, respectively. Two adjacent storage shelving plate s are connected and fixed with each other via a tenon portion of one of the two adjacent storage plates and a blind mortise portion of the other of the two adjacent storage plates.

In some embodiments, the conjunction portion includes a first slideway and a second slideway. The first slideway and the second slideway are disposed at two sides of the storage shelving plate, respectively. Two adjacent storage shelving plate s are connected and fixed with each other via a first slideway of one of the two adjacent storage plates and a second slideway of the other of the two adjacent storage plates.

The present disclosure provides a storage shelving plate and a storage shelving system. The storage shelving plate has successively disposed supporting surfaces, which are not only configured for disposing small objects, but also configured for avoiding movement or separation of a net frame caused by moving the objects on the storage shelving plate, thereby improving comfort of a user. Moreover, the storage shelving plate can further cover spines on the net frame, so as to avoid the metal spines on the net frame scratching the user, thereby improving safety of the user.

BRIEF DESCRIPTION OF THE DRAWINGS

In order to better describe and explain the embodiments and/or examples of those inventions disclosed herein, one or more drawings may be referred to. The additional details or examples used to describe the drawings should not be considered as limiting the scope of any of the disclosed inventions, the currently described embodiments and/or examples, and the best mode of these inventions currently understood.

FIG. 13 is a partial enlarged drawing of a portion B in FIG. 12.

FIG. 14 is a structural schematic diagram of a suspension member in FIG. 12.

FIG. 15 is a structural schematic diagram of a storage shelving plate in a sixth embodiment of the present disclosure.

FIG. 16 is a structural schematic diagram of a storage shelving plate in a seventh embodiment of the present disclosure.

Figure 1:
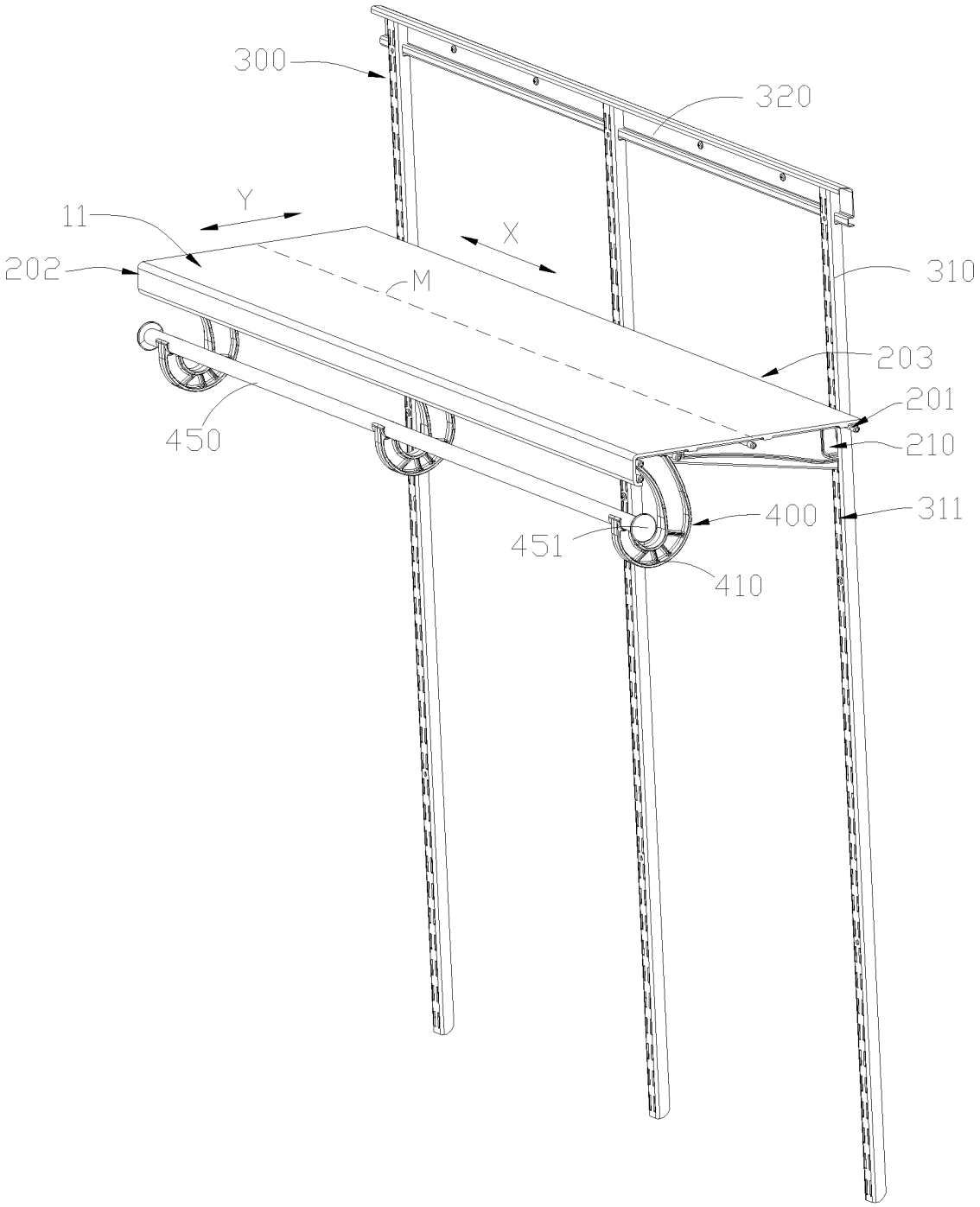
FIG. 1 is a structural schematic diagram of a storage shelving system in a first embodiment of the present disclosure.

100 represents a storage shelving plate; 10 represents a plate body; 11 represents a supporting surface 11; 12 represents a back surface; 121 represents a reserved groove; 122 represents a first reserved portion; 123 represents a second reserved portion; 13 represents a connecting rib; 20 represents a first mounting member 20; 21 represents a first bending portion; 22 represents a third bending portion; 30 represents a second mounting member; 31 represents a second bending portion; 32 represents a fourth bending portion; 33 represents a second hook portion; 40 represents a third mounting member; 41 represents a clamping member; 42 represents a locating member; 421 represents a mounting groove; 50 represents a first convex rib; 60 represents a fixing member; 61 represents a fixing portion; 611 represents a rotating curved surface; 612 represents a stopper; 613 represents a first groove; 62 represents a swirling portion; 70 represents a conjunction portion; 71 represents a tenon portion; 72 represents a blind mortise portion; 73 represents a first slideway; 74 represents a second slideway; 200 represents a storage shelving system; 201 represents a storage component; 202 represents a first side; 203 represents a second side; 210 represents a supporting frame; 2101 represents a first mounting position 2101; 2102 represents a second mounting position 2102; 211 represents a frame body; 2111 represents a first frame body; 2112 represents a second frame body; 2113 represents a connecting portion; 212 represents an assembly portion; 2121 represents a first protrusion; 2122 represents a second protrusion; 213 represents a first hook portion; 2131 represents a first accommodating groove; 214 represents a third hook portion; 2141 represents a second accommodating groove; 215 represents a third protrusion; 216 represents a supporting member; 2161 represents a second groove; 2162 represents a third groove; 217 represents a fourth groove; 218 represents a second convex rib; 219 represents a clipping member; 2191 represents a fourth hook portion; 2192 represents a fourth protrusion; 220 represents a net frame; 2201 represents a third mounting position 2201; 2202 represents a fourth mounting position 2202; 2203 represents a loading plane; 221 represents a first set of rods; 2211 represents a first rod; 2212 represents a second rod; 2213 represents a third rod; 2214 represents a middle rod; 2215 represents a laterally bending plane; 222 represents a second set of rods; 223 represents a mesh; 224 represents a first end cap; 300 represents a bracket; 310 represents a longitudinal rod; 311 represents a through hole; 320 represents a transverse rod; 400 represents a suspension member; 410 represents a curving portion; 411 represents a third convex rib; 420 represents a fifth groove; 430 represents a sixth groove; 440 represents a seventh groove; 450 represents an attached rod; and 451 represents a second end cap.

DETAILED DESCRIPTION

The technical solutions in the embodiments of the present disclosure will be clearly and completely described below in conjunction with the drawings in the embodiments of the present disclosure. Obviously, the described embodiments are only a part of the embodiments of the present disclosure, rather than all the embodiments. Based on the embodiments in this application, all other embodiments obtained by those of ordinary skill in the art without creative work are within the scope of protection of this application.

It should be noted that when a component is referred to as being "connected to" another component, it can be directly on the other component or a central component may also exist. When a component is considered to be "disposed on" another component, it can be directly installed on another component or a centered component may exist at the same time. When a component is considered to be "fixed" to another component, it can be directly fixed to the other component or there may be a centered component at the same time.

Unless otherwise defined, all technical and scientific terms used herein have the same meaning as commonly understood by one of ordinary skill in the art of this application. The terminology used in the specification of the application herein is only for the purpose of describing specific embodiments, and is not intended to limit the application. The term "or/and" as used herein includes any and all combinations of one or more related listed items.

Figure 2:
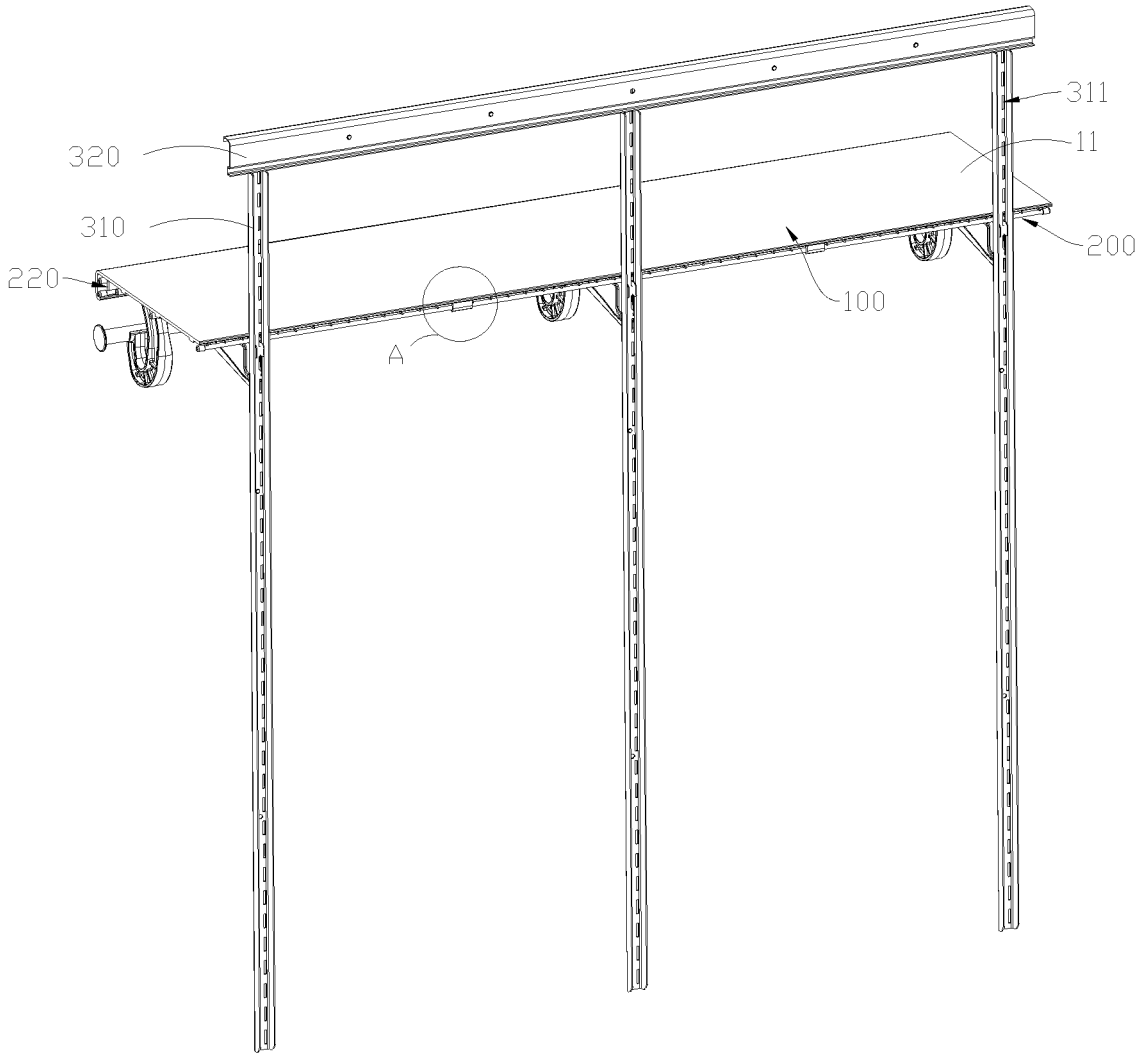
FIG. 2 is the structural schematic diagram of the storage shelving system in FIG. 1 from another angle.

As shown in FIG. 1 and FIG. 2, a storage shelving system 200 can be widely used in workplaces such as supermarket, warehouse, family and the like.

In general, a storage shelving system 200 includes a bracket 300 and a storage shelving plate 201. The storage shelving plate 201 can be disposed on the bracket 300, and the storage component 201 can be configured for bearing objects. In some embodiments, the storage component 201 includes a supporting frame 210 and a net frame 220. Wherein the bracket 300 can be provided with moving wheels (not shown in the figures) at the bottom, which can facilitate moving the storage shelving system 200. The supporting frame 210 can be detachably disposed on the bracket 300, and the net frame 220 can be detachably disposed on the supporting frame 210. The net frame 220 includes a net-shaped loading plane 2203 (referring to FIG. 10) being configured for bearing the objects. It should be understood that a formation and a mounting method of each component of the storage shelving system 200 are not limited in the present disclosure. The bracket 300 can be provided without the moving wheels, but disposed on the ground. The net frame 220 can be directly disposed on the bracket 300 without the supporting frame 210. The supporting frame 210 and/or the net frame 220 can be not disposed on the bracket 300, but disposed on other structures, such as a wall, an upright and the like.

Generally, the bracket can 300 include a longitudinal rod 310 and a transverse rod 320. Both the longitudinal rod 310 and the transverse rod 320 can be made of metal. The longitudinal rod 310 can be approximately perpendicular to the transverse rod 320. In some embodiments, the longitudinal rod 310 can slide along the transverse rod 320. The longitudinal rod 310 can be pre-connected to the transverse rod 320 in a mounting process. This can not only facilitate operation of an operator, but also ensure uniformity of all angles between the transverse rod 320 and each longitudinal rod 310. The specific structure of the bracket can further refer to U.S. Pat. Nos. 7,543,731 and 9,436,363.

It should be understood that the longitudinal rod 310 and the transverse rod 320 can be merely pre-connected by a slidable connection, alternatively, can be further fixed by methods of threaded connection, welding, clipping and the like after pre-connected. In the present disclosure, a shape and a material of the bracket 300 is not limited. The longitudinal rod 310 and the transverse rod 320 can be made from common materials such as plastic and the like. Moreover, the bracket 300 can be provided without the transverse rod 320 in some embodiments.

In some embodiments, the longitudinal rod 310 and/or the transverse rod 320 can be provided with a mounting hole (not numbered). The mounting hole can be configured for fixing the longitudinal rod 310 and/or the transverse rod 320 to the wall or other structures. In some embodiments, the longitudinal rod 310 and/or the transverse rod 320 can be provided without the mounting hole.

A through hole 311 can be disposed on the longitudinal rod 310, and the supporting frame 210 can be disposed on the longitudinal rod 310 via the through hole 311. In some embodiments, a plurality of through holes 311 can be disposed on the longitudinal rod 310. The plurality of through holes 311 can be disposed along a longitude direction of the longitudinal rod 310, so that the supporting frame 210 can be disposed on the longitudinal rod 310 at different heights. It should be understood that the plurality of through holes 311 can be uniformly disposed along the longitude direction of the longitudinal rod 310; alternatively, the through holes 311 can be disposed according to actual requirement. Furthermore, the plurality of through holes 311 can be disposed in pairs. Each pair of through holes 311 can be disposed at a same height along the longitudinal rod 310, so as to enhance stability of connection between the supporting frame 210 and the longitudinal rod 310.

Figure 3:
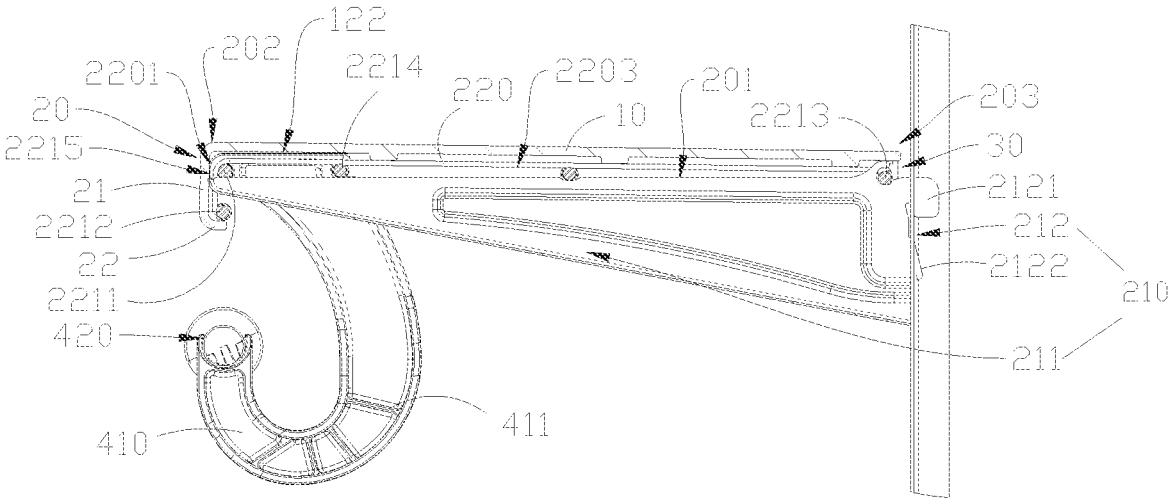
FIG. 3 is a structural schematic diagram of a partial of the storage shelving system in FIG. 1.
Figure 4:
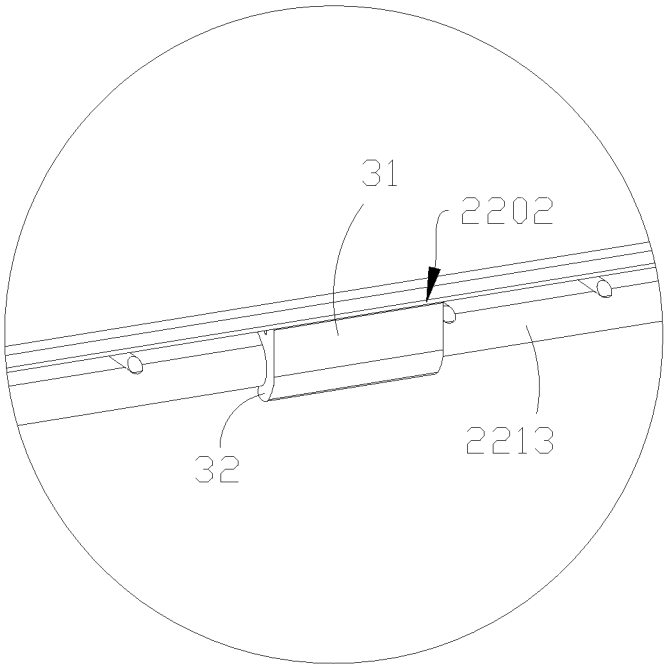
FIG. 4 is a partial enlarged drawing of a portion A in FIG. 2.

Referring to FIG. 3, the supporting frame 210 can include a frame body 211 and an assembly portion 212 fixed to the frame body 211. The frame body 211 can be configured for bearing the net frame 220, and the assembly portion 212 can be configured for disposing the supporting frame 210 on the bracket 300. In some embodiments, the assembly portion 212 can be detachably disposed on the bracket 300.

Figure 7:
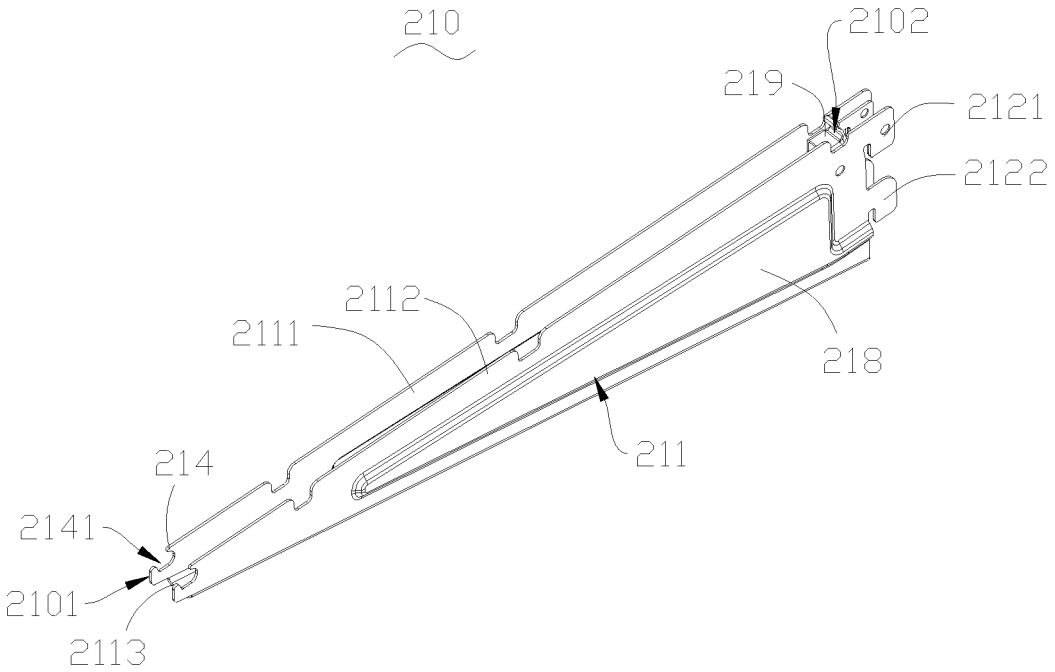
FIG. 7 is a structure diagram of a supporting frame in FIG. 6.

For convenience, referring to FIG. 7, the frame body 211 can be generally made from metal, and includes a first frame body 2111, a second frame body 2112 and a connecting portion 2113. Both the first frame body 2111 and the second frame body 2112 can be triangle sheet-shaped. The connecting portion 2113 can be configured for connecting the first frame body 2111 and the second frame body 2112. A longitudinal cross section of the first frame body 2111, the connecting portion 2113 and the second frame body 2112 can be U-shaped. The above structure of the frame body 211 is merely one of the embodiments of the frame body 211. In the present disclosure, a shape and a material of the frame body 211 is not limited, as long as the frame body 211 can be disposed on the bracket 300 and/or the net frame 220 and bear objects having certain weight.

The assembly portion 212 can include a first protrusion 2121 protruding from the frame body 211 and clamping to the through hole 311 on the longitudinal rod 310. In some embodiments, both the first frame body 2111 and the second frame body 2112 can be provided with the first protrusion 2121, and the two first protrusions 2121 can be located at the same height, so as to clamp to two parallel through holes 311, thereby improving stability of a connection between the frame body 211 and the longitudinal rod 310.

Figure 6:
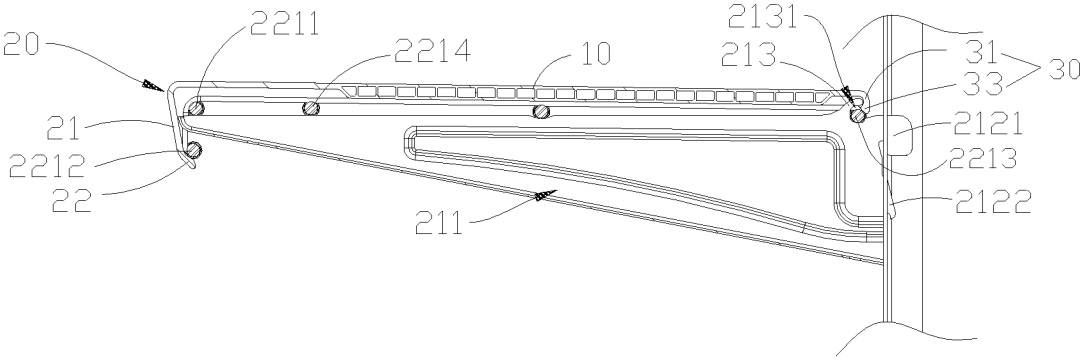
FIG. 6 is a structural schematic diagram of a storage shelving system in a third embodiment of the present disclosure.

Furthermore, the assembly portion 212 further can include a second protrusion 2122 protruding from the frame body 211 and clamping to the through holes 311 on the longitude rod 310. The second protrusion 2122 and the first protrusion 2121 can be located at different heights. In the same way, the assembly portion 212 can include two second protrusions 2122 disposed on the first frame body 2111 and the second frame body 2112, respectively, and this will not be described in details hereinafter. The second protrusion 2122 can improve the stability of the connection between the frame body 211 and the longitudinal rod 310, and provide larger bearing capacity to the frame body 211. In the embodiment shown in FIG. 3, the first protrusion 2121 and the second protrusion 2122 can have different shapes. The first protrusion 2121 is rectangle sheet-shaped and the second protrusion 2122 is strip sheet-shaped. In some embodiments, the shape of the first protrusion 2121 and the shape of the second protrusion 2122 can be approximately the same. Referring to FIG. 6, both the first protrusion 2121 and the second protrusion 2122 can be approximately rectangle sheet-shaped.

Figure 10:
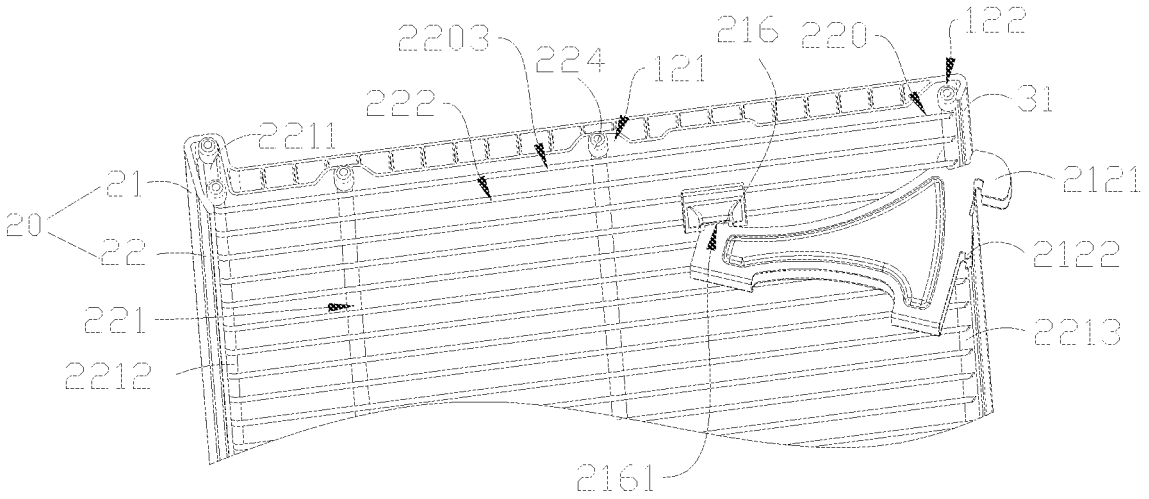
FIG. 10 is a structural schematic diagram of a partial of the storage shelving system in FIG. 9 from another angle.

For convenience, referring to FIG. 10, net frame 220 can include a first set of rods 221 and a second set of rods 222. The first set of rods 221 and the second set of rods 222 can include a plurality of rods, respectively. A preset angle can be defined between each rod of the first set of rods 221 and each rod of the second set of rods 222, and fixed with each other. In some embodiments, both the first set of rods 221 and the second set of rods 222 can be made of metal materials. Moreover, the first set of rods 221 and the second set of rods 222 can be formed, respectively; and then welded together, so as to improve mechanic strength of the net frame 220. In general, the first set of rods 221 can be approximately perpendicular to the second set of rods 222. In some embodiments, the first set of rods 221 can be inclined to the second set of rods 222. For example, the first set of rods 221 and the second set of rods 222 can form a parallelogram-shaped mesh 223.

In the present disclosure, the first set of rods 221 can be a plurality of rods extending along a length direction of the storage shelving plate 100 (if the storage shelving system 200 include a combination of a plurality of storage shelving plate s, the first set of rods 221 can be a plurality of rods extending along a length of combined storage shelving plate s, i.e., direction X in FIG. 1). In the present disclosure, the second set of rods 222 can be a plurality of rods extending along a width direction of the storage shelving plate 100 (i.e., direction Y in FIG. 1).

When the mounting member of the storage shelving plate 100 is fixed by a rod disposed along the length direction of the storage shelving plate 100, the connection can be more stable. In some embodiments, an outer diameter of a rod in the first set of rods 221 can be larger than that of a rod in the second set of rods 222, so that the mechanical strength of the first set of rods 221 can be increased. Therefore, deformation of the first set of rods 221 can be avoided while using the storage shelving system 200. In some embodiments, the outer diameter of the rod in the first set of rods 221 can be the same as that of the rod in the second set of rods 222. When the mounting member is fixed to the rod of the second set of rods 222, the outer diameter of the rod in the second set of rods 222 can be larger than that of the rod in the first set of rods 221. A structure of the net frame 220 can be defined according to actual requirement.

The net frame 220 can be connected to the supporting frame 210 by different methods. The storage shelving system 200 can have a first side and a second side separated with each other. The supporting frame 210 can be fixed to the net frame 220 via matching therebetween at a first side 202 and a second side 203, or via matching therebetween at other positions. In the present disclosure, two sides divided by a trunk line (i.e., line-M shown in FIG. 1) of the storage shelving system along a Direction Y as shown in FIG. 1 can be named as the first side 202 and the second side 203. Moreover, in the present disclosure, one side of a member near the first side 202 can be regarded as a first side of the member, and the other side of the member near the second side 203 can be regarded as a second side of the member.

Figure 5:
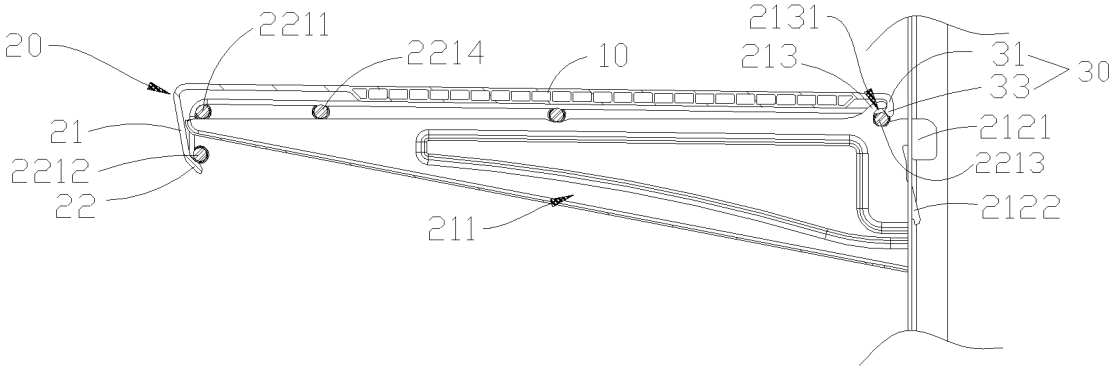
FIG. 5 is a structural schematic diagram of a storage shelving system in a second embodiment of the present disclosure.
Figure 12:
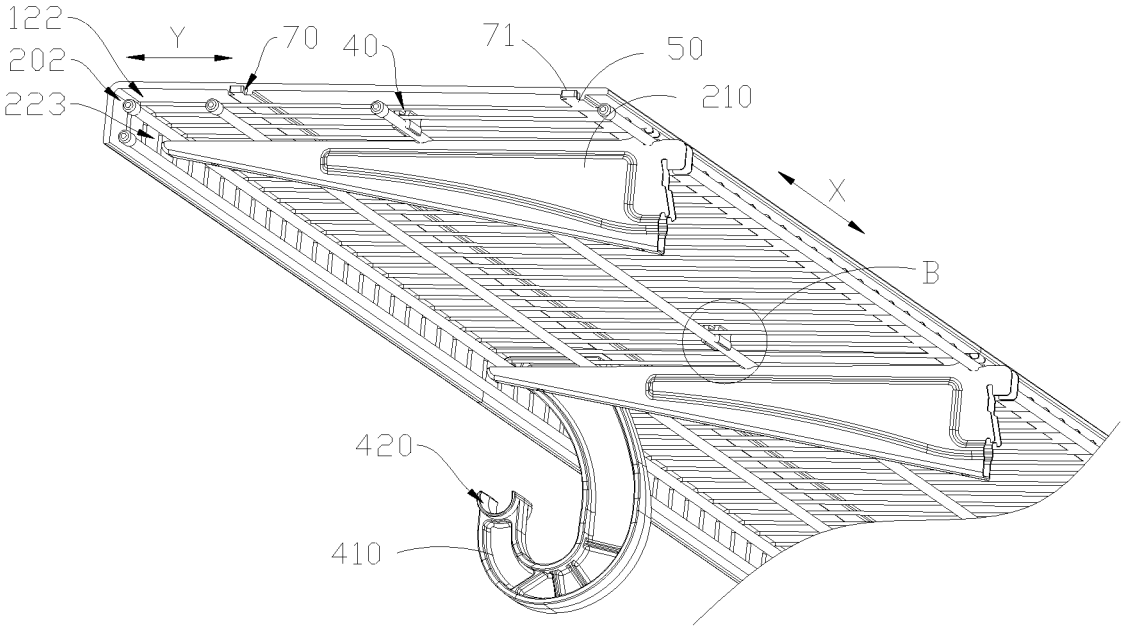
FIG. 12 is a structural schematic diagram of a storage shelving system in a fifth embodiment of the present disclosure.

As shown in the embodiments of FIG. 3, FIG. 5 and FIG. 12, the supporting frame 210 can be fixed to the net frame 220 via matching therebetween at a first side 202 and a second side 203. The net frame 220 can include a plane net-shaped loading plane 2203. The net frame 220 can bend at one side of the loading plane 2203 to form a laterally bending plane 2215. A preset angle can be defined between the laterally bending plane 2215 and the loading plane 2203, and the laterally bending plane 2215 can have the mesh 223. In some embodiments, the laterally bending plane 2215 can be approximately perpendicular to the loading plane 2203. In some embodiments, an acute angle or an obtuse angle can be defined between the laterally bending plane 2215 and the loading plane 2203.

In some embodiments, the first set of rods 221 of the net frame 220 can include a first rod 2211 and a second rod 2212 at the first side 202. The plurality of rods in the second set of rods 222 can have an end with a curved surface. The first rod 2211, the second rod 2212 and the second set of rods 222 can define the laterally bending plane 2214. The supporting frame 210 can be approximately triangle-shaped. One end of the supporting frame can insert into the mesh 223 of the laterally bending plane 2215, so as to locate the net frame 220 and the supporting frame 210 at the first side 202.

The net frame 220 can be provided with the third rod 2213 at the second side 203. The supporting frame 210 can be provided with a first hook portion 213 at the second side 203. The first hook portion 213 can extend along a direction away from the first side 202. A first accommodating groove 2131 can be further disposed on the supporting frame 210. The third rod 2213 can be accommodated in the first accommodating groove 2131, and can be located by the first hook portion 213.

Therefore, at the first side 202, the supporting frame 210 can be located and fixed to the net frame 220 via inserting in the mesh 223 on the laterally bending plane 2215 of the net frame 220. At the second side 203, the net frame 220 can be located and fixed to the supporting frame 210 via the first hook portion 213. Therefore, the net frame 220 can be disposed on the supporting frame 210.

Figure 8:
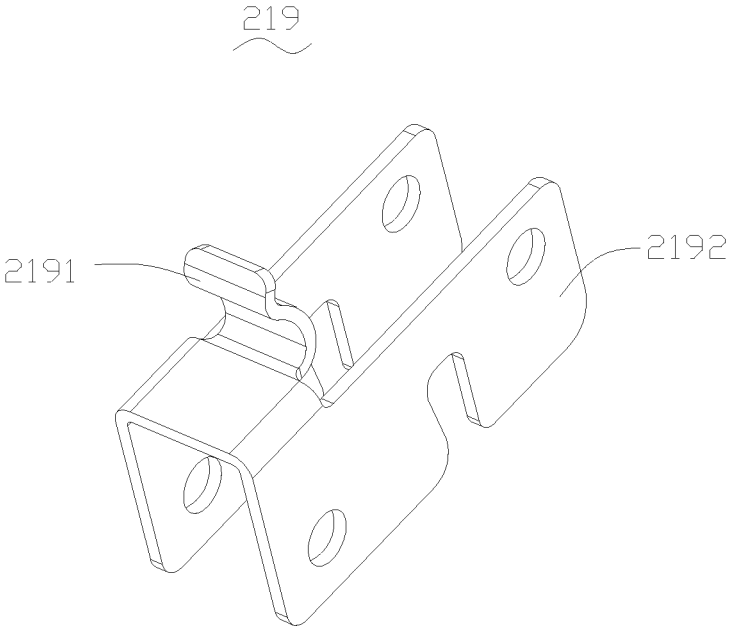
FIG. 8 is a structure diagram of a clipping member in FIG. 6.

The supporting frame 210 can also be fixedly connected to the net frame 220 by a method shown in FIG. 6 to FIG. 8. Referring to FIG. 6 to FIG. 8, a structure of the net frame 220 can be substantially the same as the structure of the net frame 220 shown above, and will not be described in detail hereinafter. A second accommodating groove 2141 can be provided at the first side 202 of the supporting frame 210, and an inner wall of the second accommodating groove 2141 can protrude outwards and define a third hook portion 214. The first rod 2211 can be accommodated in the second accommodating groove 2141, and fixed by the third hook portion 214. The supporting frame 210 can further include a clipping member 219 at the second side 203. The clipping member 219 can be fixed to the first frame body 2111 and the second frame body 2112, and located in the first accommodating groove 2131. The clipping member 219 can include a fourth hook portion 2191 which is elastic. The third rod 2213 can be accommodated in the first accommodating groove 2131, and fixed via the fourth hook portion 2191. Therefore, at the first side 202, the net frame 220 and the supporting frame 210 can be fixed via the third hook portion 214. At the second side 203, the net frame 220 and the supporting frame 210 can be fixed via the fourth hook portion 2191. Therefore, the net frame 220 can be disposed on the supporting frame 210.

Figure 9:
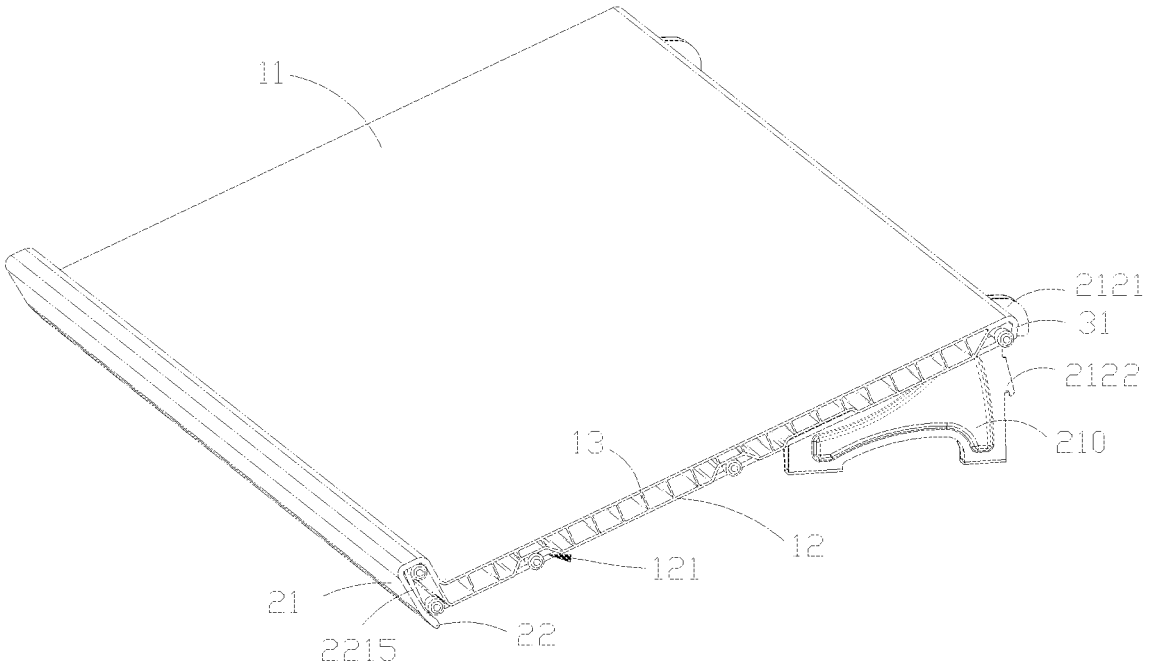
FIG. 9 is a structural schematic diagram of a storage shelving system in a fourth embodiment of the present disclosure.
Figure 11:
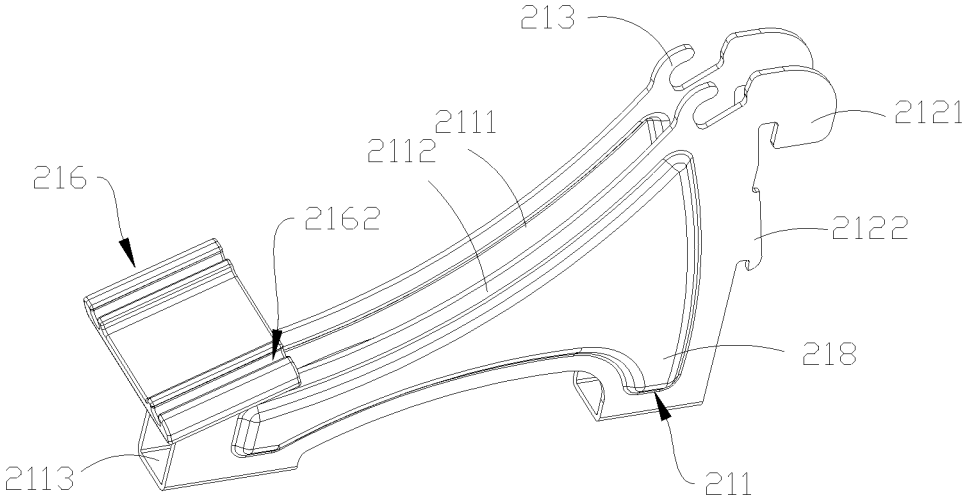
FIG. 11 is a structural schematic diagram of a supporting frame in FIG. 9.

The supporting frame 210 can also be connected to the net frame 220 by a method shown in FIG. 9 to FIG. 11. Referring to FIG. 9 to FIG. 11, the supporting frame 210 can further include a supporting member 216. A third protrusion 215 can be disposed at an end of the supporting frame 210 away from the first side 202. A second groove 2161 can be disposed at one side of the supporting member 216 near the supporting frame 210. The supporting member 216 can be inserted in and fixed to the third protrusion 215 via the second groove 2161. A third groove 2162 can be disposed at one side of the supporting member 216 near the net frame 220. The rod in the second set of rods 222 of the net frame 220 can be inserted in the third groove 2162. The second sides of the net frame 220 and the supporting frame 210 can be the same as those in the embodiment shown in FIG. 3, FIG. 5 and FIG. 12, and can be fixed via the first hook portion 213, which will not be described in details hereinafter. Therefore, the net frame 220 can be disposed on the supporting frame 210 via the supporting member 216 and the first hook porting 213.

In some embodiments, referring to FIG. 6, a middle rod 2214 can be disposed between the first rod 220 and the third rod 2213 of the net frame 220. A fourth groove 217 can be disposed at a position on the supporting frame 210 corresponding to the middle rod 2214. When the net frame 220 is disposed on the supporting frame 210, the fourth groove 217 can give place to the middle rod 2114. Furthermore, if the fourth groove 217 has a small rabbet, the fourth groove 217 can further be configured for fixing the middle rod 2214.

In some embodiments, the first frame body 2111 and/or the second frame body 2112 can be provided with a second convex rib 218, so as to improve mechanical strength of the supporting frame 210.

In some embodiments, referring to FIG. 10, a first end cap 224 can be provided on the first set of rods 221 and/or the second set of rods 222, so as to prevent a sharp end of the net frame 220 from hurting the user.

In a conventional embodiment, because the net frame itself has meshes plurality of holes, some smaller objects are likely to fall through the holes when placed on the net frame. Moreover, there are also some objects that are easy to get stuck in the holes, and when the objects are taken back, the net frame easily fall from the supporting frame or bracket. In addition, in order to increase bearing capacity of the net frame, metal materials are generally used. However, metal materials will inevitably appear burrs during processing, which can easily scratch the user.

Therefore, the present disclosure provides a storage shelving plate 100 which can be disposed on a supporting frame 210 and/or a net frame 220, and a storage shelving system 200 including the storage shelving plate 100.

The storage shelving plate 100 can be provided with a mounting member (unlabeled). The storage shelving plate 100 can be disposed on the external structure via the mounting member. In embodiments of the present disclosure, the external structure can be the storage component 201. Specifically, in some embodiments, the storage shelving plate 100 can be disposed on the supporting frame 210 via the mounting member; in some embodiments, the storage shelving plate can be disposed on the net frame 220 via the mounting member; in some embodiments, the storage shelving plate 100 can be disposed on the supporting frame 210, and then disposed on the supporting frame 210 and/or the net frame 220 via the mounting member.

The storage shelving plate 100 can include a plate body 10. The plate body 10 can have a supporting surface 11 and a back surface 12 separated from each other. The supporting surface 11 can be configured for supporting objects. In some embodiments, the supporting surface can be plane-shaped. In some embodiments, the supporting surface 11 can be in other shapes according to requirements.

It should be noted that the storage shelving plate 100 in the present disclosure can be plate-shaped made by methods of injection molding or extrusion molding. Compared with net-shaped net frame 220, the storage shelving plate 100 of the present disclosure can have a continuous supporting surface 11.

Referring to FIG. 1 to FIG. 11, in some embodiments, the storage shelving plate 100 can be provided with a first mounting member 20 at the first side 202, and a second mounting member 30 at the second side 203. The first mounting member 20 can match with the second mounting member 30 to dispose the storage shelving plate 100 on the storage component 201. It should be understood that, in some embodiments not shown in the present disclosure, the storage shelving plate 100 can be independently provided with the first mounting member 20 or the second mounting member 30, and the side of the storage shelving plate without the mounting member can be disposed on the storage component 201 via the clipping member.

In some embodiments, the first mounting member 20 can abut against a first side 202 of the storage component 201. The second mounting member 30 can abut against a second side 203 of the storage component 201. At least one of the first mounting member 20 and the second mounting member 30 can be elastic. The first side of the storage component 201 can match with the first mounting member 20, so as to avoid the storage shelving plate 100 from turning over towards the second side of the storage component 201. The second side of the storage component 201 can match with the second mounting member 30, so as to avoid the storage shelving plate 100 from turning over towards the first side of the storage component 201. The storage shelving plate 100 can tightly match with the storage component 201 via a pre-tightening force between the first mounting member and the storage shelving plate and/or between the second mounting member and the storage shelving plate, so as to improve the stability of connection between the storage shelving plate 100 and the storage component 201.

In some embodiments, the first mounting member 20 and the second mounting member 30 can be elastic, which facilitates disposing the storage shelving plate 100. In some embodiments, only the first mounting member 20 or the second mounting member 30 can be elastic, and both the first mounting member 20 and the second mounting member 30 can tightly match with the storage component 201. It should be understood that in some embodiments, the first mounting member 20 and the second mounting member 30 can be disposed on the storage component 201 by other conventional methods, for example, via a clipping structure and the like. This will not be described in detail hereinafter.

It should be noted that "elastic" represents that the first mounting member 20 and/or can slightly deform; alternatively, the first mounting member 20 and/or the second mounting member 30 can rotate through a certain degree relative to the plate body 10. Therefore, the storage shelving plate 100 can elastically abut against the storage component 201 after being disposed on the storage component 201.

Both the first side of the storage shelving plate 100 and the second side of the storage shelving plate 100 can be disposed on the net frame 220 or the supporting frame 210. And the two methods of disposing can be combined together. How to dispose the storage shelving plate 100 on the supporting frame or the net frame 220 at the first side 202, and how to dispose the storage shelving plate 100 on the supporting frame 210 or the net frame 220 at the second side 203 will be described in detail hereinafter. The user can choose a suitable method according to actual needs.

Firstly, how to dispose the storage shelving plate 100 on the supporting frame 210 at the first side 202 will be described hereinafter.

The supporting frame 210 can include a first mounting position 2102 and a second mounting position 2102 separated from each other. The first mounting member 20 and the second mounting member can be disposed on the first mounting position 2101 and the second mounting position 2102, respectively. Moreover, the first mounting member 20 and the second mounting member 30 can cooperate with each other, so that the storage shelving plate 100 can be disposed on the supporting frame 210.

In some embodiments, the first mounting member 20 can be elastic, and the first mounting member 20 can be located at the first side of the plate body 10. A preset angle can be defined between the first mounting member 20 and the plate body 10. And the first mounting member 20 can elastically abut against the first mounting position 2101 of the supporting frame 210. In some embodiments, an end of the supporting frame 210 can be regarded as the first mounting position 2101.

Specifically, in order to facilitate molding, the first mounting member 20 can include a first bending portion 21. The first bending portion 21 can bend relative to the plate body 10 and can be integrally formed with the plate body 10. In the present disclosure, the method for molding the first bending portion 21 and the plate body 10 is not limited. The first bending portion 21 and the plate body 10 can be molded, respectively; and then fixed and connected by methods such as gluing and the like.

In some embodiments, in order to prevent the storage shelving plate 100 from separating from the supporting frame 210, the first bending portion 21 can be plate-shaped, an acute angle can be defined between the first bending portion 21 and the plate body 10. It should be understood that in some embodiments, if another structure being configured for preventing the storage shelving plate 100 from separating from the supporting frame 210 is provided (e.g., a third bending portion 22), the angle defined between the first bending portion 21 and the plate body 10 can be an acute angle, a right angle or an obtuse angle.

Furthermore, the first mounting member 20 can further include a third bending portion 22. The third bending portion 22 can be fixed to the first bending portion 21 and bend towards the second side 203. The third bending portion 22 can be configured for preventing the first mounting member 20 from separating from the supporting frame 210.

Specifically, in order to facilitate molding, the third bending portion 22 can bend relative to the first bending portion 21 and be integrally formed with the first bending portion 21. In the present disclosure, the method for molding the first bending portion 21 and the third bending portion 22 is not limited. The first bending portion 21 and the third bending portion 22 can be molded, respectively; and then fixed and connected by methods such as gluing and the like.

In some embodiments, the third bending portion 22 can be plate-shaped, and an angle defined between the third bending portion 22 and the first bending portion 21 can be a right angle or an obtuse angle. This not only can facilitate processing the third bending portion 22, but also can facilitate disposing the first mounting member 20 on the supporting frame 210, resulting in a relatively good limiting effect. The third bending portion 22 is not limited to in a plate shape, the third bending portion 22 can be arc-shaped and protrude towards the second side 203. Referring to FIG. 6, the third bending portion 22 can be in other common shapes such as ripple-shaped and the like, as long as it can have a good limiting effect.

Secondly, how to dispose the storage shelving plate 100 on the supporting frame 210 at the second side 203 will be described hereinafter.

In some embodiments, the second mounting member 30 can be elastic, and the second mounting member 30 can be located at the second side of the plate body 10. A preset angle can be defined between the second mounting member 30 and the plate body 10. And the second mounting member 30 can elastically abut against the second mounting position 2102 of the supporting frame 210. In some embodiments, the second mounting position 2102 can have a plurality of forms, such as a first hook portion 213, a fourth hook portion 2191 and the like.

When the first hook portion 213 is regarded as the second mounting position 2102, the second mounting member 30 can include a second bending portion 31 and a second hook portion 33. The second bending portion 31 can be fixed to the plate body 10, and a preset angle can be defined between the plate body 10 and the second bending portion 31. The second hook portion 33 can protrude from the second bending portion 31 towards the first side 202. The second hook portion 33 can be configured for preventing the second mounting member 30 from separating from the supporting frame 210.

Furthermore, the storage shelving plate 100 can elastically abut against the first hook portion 213 or the fourth hook portion 2191 via the second hook portion 33, so that the storage shelving plate can be clamped to the supporting frame 210.

In some embodiments, in order to facilitate molding, the second bending portion 31 and the second hook portion 33 can be integrally formed with the plate body 10. In the present disclosure, the method for molding the second bending portion 31, the second hook portion 33 and plate body 10 is not limited. The second bending portion 31, the second hook portion 33 and plate body 10 can be molded, respectively; and then fixed and connected by methods such as gluing and the like.

When the fourth hook portion 2191 is regarded as the second mounting position 2102, the supporting frame 210 can include a clipping member 219. The clipping member 219 can be provided with the fourth hook portion 2191. The second mounting member 30 can abut against the second hook portion 33 via the fourth hook portion 2191. The fourth hook portion 2191 can prevent the second mounting member 30 from separating from the supporting frame 210.

Thirdly, how to dispose the storage shelving plate 100 on the net frame 220 at the first side 202 will be described hereinafter.

The net frame 220 can include a third mounting position 2201 and a fourth mounting position 2202 separated from each other. The first mounting member 20 and the second mounting member 30 can be disposed on the third mounting position 2201 and the fourth mounting position 2202, respectively. The storage plate can be disposed on the net frame 220 via matching between the first mounting member 20 and the second mounting member 30.

The method for disposing the storage shelving plate 100 on the first side of the supporting frame 210 can also be used for disposing the storage shelving plate 100 on the first side of the net frame 220. The difference between the two methods can merely be the sizes of the first bending portion 21 and the third bending portion 22, and a position at which the first mounting member 20 abuts against. When the storage shelving plate 100 is disposed on the first side of the net frame 220, the first mounting member 20 can elastically abut against the third mounting position 2201 of the net frame 220. The third mounting position 2201 can have a plurality of forms, such as a first rod 2211, a third rod 2213, or a laterally bending plane 2215 bending towards a side away from the supporting surface 11. The first mounting member 20 can elastically abut against the first rod 2211, the third rod 2213 or the laterally bending plane 2215 via the first bending portion 21 and/or the third bending portion 22, respectively.

When the third mounting position 2201 is the laterally bending plane 2215, and the laterally bending plane 2215 bends towards the side away from the bearing frame 210 (i.e., bending upwards), a cross section of the first mounting member 20 can be defined as U-shaped, so that the laterally bending plane 2215 can be inserted into and disposed in the first bending portion 21 (as shown in FIG. 9 and FIG. 10). It should be understood that a contact between the first bending portion 21 and the laterally bending plane 2215 can a line contact, a partial surface contact, or an overall surface contact, and will not be limited herein.

In order to further improve stability of a connection between the first shelving plate 100 and the laterally bending plane 2215, the third bending portion 22 can be further provided other than the first bending portion 21. The structure of the third bending portion can be the same as that described above and will not be described in details hereinafter.

Finally, how to dispose the storage shelving plate 100 on the net frame 220 at the second side 203 will be described hereinafter.

The second mounting member 30 can be elastic, and the second mounting member 30 can be disposed on the second side of the plate body 10. A preset angle can be defined between the second mounting member 30 and the plate body 10. The second mounting member can elastically abut against the fourth mounting member 2202 of the net frame 220. In some embodiments, the fourth mounting position 2202 can be the third rod 2213.

In some embodiments, the second mounting member 30 can include a second bending portion 31. The second bending portion 31 can be fixed to the plate body 10. A preset angle can be defined between the second bending portion 31 and the plate body 10, and the preset angle can be an acute angle. The second bending portion 31 can elastically abut against net frame 220. Furthermore, when the third rod 2213 is regarded as the fourth mounting position 2202 rod, the third rod 2213 can be located via a first accommodating groove 2131 and a fourth hook portion 2191, or located via other external structures. One side of the third rod 2213 can elastically abut against the second bending portion 31 or abut against a corner defined by the second bending portion 31 and plate body 10. This can provide relatively good fixing effect.

In some embodiments, in order to improve stability of connection between the storage shelving plate 100 and the net frame 220, the second mounting member 30 can include the second bending portion 31 and a fourth bending portion 32. The second bending portion 31 can be fixed to the plate body 10, and a preset angle can be defined between the second bending portion 31 and the plate body 10. The fourth bending portion 32 can be fixed to the second bending portion 31, and bend towards the first side 202. The storage shelving plate 100 can be disposed on the net frame 220 via the second bending portion 31 and the fourth bending portion 32. The fourth bending portion 32 can prevent the second mounting member 30 from separating from the net frame 220.

In some embodiments, the fourth bending portion 32 can be arc-shaped, and a radius of the arc of the fourth bending portion 32 can match with that of a periphery of the third rod 2213.

In some embodiments, the net frame 220 can be disposed on the external structure (e.g., a bracket) via the supporting frame 210. In order to avoid interference between the second mounting member 30 and supporting frame 210, the storage shelving plate 100 can include a plurality of second mounting members 30. The plurality of second mounting members 30 can elastically abut against the third rod 2213, respectively, and give place to the supporting frame 210.

It should be understood that when the net frame 220 is fixed by other methods, the second mounting member 30 can have a continuous structure, as long as the structure does not influence matching between the second mounting member 30 and the fourth mounting position 2202. If the second mounting member 30 should give place to other structures, the storage shelving plate 100 can include a plurality of second mounting members 30. The first mounting member can be in the same way, and will not be repeated again herein.

In some embodiments, the second bending portion 31 and/or the fourth bending portion 32 and the plate body 10 can be integrally formed. In the present disclosure, the method for molding the second bending portion 31, the fourth bending portion 32 and the plate body 10 is not limited. The second bending portion 31, the fourth bending portion 32 and the plate body 10 can be formed, respectively, and then fixed and connected together by methods of gluing and the like.

The matching between the first mounting member 20 and the second mounting member 30 will be further described hereinafter in conjunction with some embodiments.

FIG. 1 to FIG. 4 are schematic diagrams of a first embodiment of the present disclosure. In the first embodiment, the first mounting member 20 and the second mounting member 30 can elastically abut against the laterally bending plane 2215 and the third rod 2213 of the net frame 220, respectively.

Furthermore, if a length of the supporting frame 210 in the present embodiment is increased and make the supporting frame 210 protrude from the laterally bending plane 2215 for certain distance at the first side 202, (i.e., referring to FIG. 3, a left side of the supporting frame 210 protrudes from the laterally bending plane 2215), the first mounting member 20 can also elastically abut against an end of the supporting frame 210. At this time, the first mounting member 20 can be disposed on the end of the supporting frame 210 at the first side 202.

The net frame 220 can be provided with a third rod 2213 at the second side 203. The second mounting member 30 of the storage shelving plate 100 can include a second bending portion 31 and a fourth bending portion 32. The second bending portion 31 can be approximately perpendicular to the plate body 10. The fourth bending portion 32 can be fixed to the second bending portion 31 and be approximately arc-shaped. A radius of the arc of the fourth bending portion 32 can match with that of a periphery of the third rod 2213.

Referring to FIG. 1 to FIG. 4, the net frame 220 can be disposed on the bracket 300 via the supporting frame 210. Accordingly, a plurality of second mounting members 30 can be provided to give place to the supporting frame 210. It should be understood that the net frame 220 can be fixed to other external structures by other methods. That is, both the supporting frame 210 and/or the bracket 300 can be omitted. A specific shape and a number of the second mounting member 30 can be defined according to requirements.

In order to facilitate molding a plurality of second mounting members 30, the storage shelving plate 100 in the present embodiment can be made by injection molding. Injection molding can be used for processing discontinuous structures, and the processing technology is mature.

FIG. 5 is a structural schematic diagram of a second embodiment. In the second embodiment, the first mounting member 20 and the second mounting member 30 can elastically abut against a laterally bending plane 2215 of a net frame 220 and a first hook portion 213 of a supporting frame 210, respectively.

In the second embodiment, a structure of the storage shelving system 200 at the first side 202 can be substantially the same as that of the first embodiment. Compared with the first embodiment, the angles between the first bending portion 21 and the plate body 10 are different; and the angles between the first bending portion 21 and the third bending portion 22 are different. In the second embodiment, an angle defined between the first bending portion 21 and the plate body 10 can be an acute angle, and the angle defined between the third bending portion 22 and the first bending portion 21 can be an obtuse angle.

A first hook portion 213 can be disposed on the second side of the supporting frame 210. The second mounting member 30 of the storage shelving plate 100 can be stripe-shaped, and include a second bending portion 31 and a second hook portion 33. An angle between the second bending portion 31 and the plate body 10 can be approximately a right angle. The second hook portion 33 can protrude towards the first side 202. The second hook portion 33 can abut against the first hook portion 213, so as to prevent the second mounting member 30 from separating from supporting frame 210. That is, the first hook portion 213 in the present disclosure not only can limit the third rod 2213, but also can cooperate with the second hook portion 3.

The third rod 2213 can be fixed in the first accommodating groove 2131 by the second mounting member 30, and be limited by the first hook portion 213. This can prevent the third rod 2213 from separating from the first accommodating groove 2131, and improve stability of connection between the net frame 220 and the supporting frame 210.

In the present embodiment, the shelving storage plate 100 can be molded by a method of extrusion molding. The processing technology is mature and the manufacturing cost is low.

FIG. 6 to FIG. 8 are structural schematic diagrams of the third embodiment. In the third embodiment, the supporting frame 210 can be provided with a clipping member 219, and the clipping member 219 can include a fourth hook portion 2191 which is elastic. The first mounting member 20 can elastically abut against an end of the supporting frame 210, and the second mounting member 30 can elastically abut against the fourth hook portion 2191 of the clipping member 219.

The first mounting member 20 can include a first bending portion 21 and a third bending portion 22. An angle between the first bending portion 21 and the plate body 10 can be approximately a right angle, and the third bending portion 22 can be arc-shaped, and protrude towards the first side 202, so as to prevent the first mounting member 20 from separating from the end of the supporting frame 210.

The second mounting member 30 can have a continuous stripe-shaped structure can have a continuous stripe-shaped structure, and can include a second bending portion 31 and a second hook portion 33. An angle between the second bending portion 31 and plate body 10 can be approximately a right angle, and the second hook portion 33 can protrude towards the second side 203. The second hook portion 33 can abut against the fourth hook portion 2191 of the clipping member 219, so as to prevent the second mounting member 30 from separating from supporting frame 210.

In the present disclosure, the clipping member 219 can be disposed on the first accommodating groove 2131. The clipping member 219 can further include a fourth protrusion 2192. The fourth protrusion 2192 can be clamped to a through hole 311 of a longitudinal rod 310, so as to improve strength of connection between the supporting frame 210 and the longitudinal rod 310.

In some embodiments, the fourth hook portion 2191 can be arc-shaped. When the net frame 220, the supporting frame 210 and the storage shelving plate 100 cooperate with each other, the third rod 2213 can be accommodated in the first accommodating groove 2131, and then be tightly clamped in the first accommodating groove 2131 via the fourth hook portion 2191. At the same time, the second hook portion 33 can apply a force on the fourth hook portion 2191 from another side of the fourth hook portion 2191, so as to further prevent the third rod 221 from separating from the first accommodating groove 2131, thereby improving stability of connection between the net frame 220 and the supporting frame 210. Furthermore, the fourth protrusion 2192 and the first protrusion 2121 can insert into the through hole 311 at the same time to improve the connection strength between the supporting frame 210 and the bracket, thereby increasing a bearing capacity of the supporting frame 210.

In the storage shelving system 200 of the present embodiment, due to the clipping member 219, the bearing capacity of the storage component 201 can be largely increased, so that the storage shelving system 200 can bear objects having larger mass.

In the present embodiment, the shelving storage plate 100 can be molded by a method of extrusion molding. The processing technology is mature and the manufacturing cost is low.

FIG. 9 to FIG. 11 are structural schematic diagrams of a fourth embodiment. In the fourth embodiment, the supporting frame 210 can be provided with a supporting member 216, and the net frame 220 can be detachably disposed on the supporting frame 210 via the supporting member 216 and a first hook portion 213. A first mounting member 20 and a second mounting member 30 can be disposed on the laterally bending plane 2215 of the net frame 220 and the third rod 2213, respectively.

A net frame 220 can be provided with a laterally bending plane 2215 bending upward at a first side of the storage shelving plate. The first mounting member 20 of the storage shelving plate 100 can include a first bending portion 21 and a third bending portion 22. A cross section of the first bending portion 21 can be approximately U-shaped, and an outer surface of the first bending portion 21 slightly bends inwards (i.e., on the left side of FIG. 10). An angle defined between the outer surface and a top surface of the first bending portion can be an acute angle. The third bending portion n 22 can further bend towards the second side 203, so as to improve the stability of connection between the first mounting member 20 and laterally bending plane 2215.

The net frame 220 can be provided with a third rod 2213 at the second side of the storage shelving plate 100. The second mounting member 30 of the storage shelving plate 100 can have a continuous stripe-shaped structure. The second mounting member 30 can include a second bending portion 31. The storage shelving plate 100 can elastically abut against the third rod 2213 via the second bending portion 31, so as to prevent the second mounting member 30 from separating from net frame 220. Moreover, the third rod 2213 can be tightly fixed in the first accommodating groove 2131 by the second bending portion 31 and limited by the first hook portion 213. This can prevent the third rod 2213 from separating from the first accommodating groove 2131 and improve the stability of connection between the net frame 220 and the supporting frame 210.

When the storage shelving system 200 in the present embodiment is actually used, a supporting surface 11 of the storage shelving plate 100 can be inclined (i.e., the second side of the storage shelving plate 100 can be higher than the first side of the storage shelving plate 100). The first bending portion 21 can limit the object and prevent the object from falling off from the storage shelving plate 100. Therefore, the object can be closer to the user, and facilitate the user to fetch the object.

The storage shelving system 200 in the present disclosure can be used as a shoe rack. In the present embodiment, the shelving storage plate 100 can be molded by a method of extrusion molding. The processing technology is mature and the manufacturing cost is low.

In some embodiments (e.g., the embodiments shown in FIG. 5, FIG. 6, FIG. 9 and FIG. 10), the plate body of the storage shelving plate 100 can have two layers. The two layer of the plate body 10 can be connected by a sheet-shaped connecting rib 13. This not only decreases a weight of the storage shelving plate 100, but can also increase mechanical strength of the storage shelving plate 100, and ensure supporting capacity of the storage shelving plate 100. It should be understood that the plate body 10 of the storage shelving plate 100 is not limited to two layers, but can have more layers. The connecting rib 13 is not limited to sheet-shaped, but can be other common shapes, such as is honeycomb-shaped or ripple shaped, as long as the connecting rib can connect the two plate bodies 10. Furthermore, a multi-layered plate body 10 and the connecting rib 13 can be integrally formed, so as to improve the integrality of the storage shelving plate 100, so that force on the storage shelving plate 100 can be balance when it is used. In some embodiments, the multi-layer plate body 10 and the connecting rib 13 can be formed, respectively, and then connected by methods such as gluing, thermosetting, and the like, and will not be repeated again herein.

Referring to FIG. 12 to FIG. 13 and FIG. 22 to FIG. 24, in some embodiments, the storage shelving plate 100 can be provided with a third mounting member 40. A storage shelving plate 100 can be disposed on the net frame 220 via the third mounting member 40.

In some embodiments, the third mounting member 40 can be disposed in the middle of the storage shelving plate 100, so that the storage shelving plate 100 can be stably disposed on the net frame 220. It should be understood that the storage shelving plate 100 can be disposed on the net frame 220 merely via the third mounting member 40. Alternatively, the storage shelving plate can be disposed on the net frame 220 via matching between the third mounting member 40 and other mounting members.

In some embodiments, the third mounting member 40 can be elastic, and the third mounting member 40 can be configured for elastically clamping the first set of rods 221 and/or the second set of rods 222. It should be understood that the third mounting member 40 can be disposed on the net frame 220 by other methods such as clipping.

In some embodiments, the third mounting member 40 can include a plurality of clamping members 41, and the plurality of clamping members 41 can be disposed along a lengthwise direction of the storage shelving plate 100 (i.e., the Direction X in FIG. 12).

In some embodiments, the storage shelving plate 100 can be provided with a first mounting member 20. The first mounting member 20 can have a structure similar to the first mounting member 20 described above. The storage shelving plate 100 can be disposed on the net frame 220 via the first mounting member 20 and the third mounting member 40. Wherein, the first mounting member 20 can limit the storage shelving plate 100 at the first side of the storage shelving plate 100, and the third mounting member 40 can limit the storage shelving plate 100 in the middle of the storage shelving plate 100, so as to improve stability of connection between the storage shelving plate 100 and the net frame 22.

In an embodiment not shown herein, the storage shelving plate 100 can be provided with a second mounting member 30 at the second side of the storage shelving plate 100. The second mounting member 30 can be similar to the second mounting member 30 described above. The storage shelving plate 100 can be disposed on the net frame 220 via the second mounting member 30 and the third mounting member 40. The second mounting member 30 can limit the storage shelving plate 100 at the second side of the storage shelving plate 100, and the third mounting member 40 can limit the storage shelving plate 100 in the middle of the storage shelving plate 100, so as to improve stability of the connection between the storage shelving plate 100 and the net frame 220.

In some embodiments, the third mounting member 40 can be disposed on a first set of rods 221 and limited by the second set of rods 222. Specifically, referring to FIG. 13, movement of the third mounting member 40 along a length direction of the third mounting member 40 (i.e., the direction X in FIG. 12) can be limited by adjacent two of the second set of rods 222.

The method for disposing the third mounting member 40 can be further described in conjunction with the fifth embodiment shown in FIG. 12 to FIG. 14.

In the present disclosure, a back surface 12 of the storage shelving plate 100 can be provided with a plurality of clamping members 41. The plurality of clamping members 41 can be disposed along a length direction of the storage shelving plate 100, and the clamping members 41 can be configured for clamping the middle rod 2214 of the first set of rods 221.

In some embodiments, the net frame 220 can be provided with a laterally bending plane 2215 at the first side of the net frame 220, and the laterally bending plane 2215 and the loading plane 2203 can be approximately a right angle. The storage shelving plate 100 can be provided with a first bending portion 21 at the first side of the storage shelving plate 100, and an angle between the first bending portion 21 and the plate body can be approximately a right angle. A first side of the first bending portion 21 can elastically abut against laterally bending plane 2215, so as to improve stability of connection between the storage shelving plate 100 and the net frame 220. It should be understood that the first bending portion 21 can separate from the laterally bending plane 2215, i.e., the first bending portion 21 can merely play a role of covering the laterally bending plane 2215, and the storage shelving plate 100 can be disposed on the net frame 220 merely via the clamping member 41.

In some embodiments, an inner diameter of the clamping member 41 can be smaller than an outer diameter of the middle rod 2214, and a length of a clamping arm of the clamping member 41 can be greater than the diameter of the middle rod 2214, so as to increase a clamping force of the clamping member 41 to the middle rod 2214, thereby increasing the stability of the clamping.

In the present embodiment, the back surface 12 of the storage shelving plate 100 can be further provided with a first convex rib 50, which can fill up a gap between the back surface 12 of the storage shelving plate 100 and the loading plane 2203, so as to prevent the plate body of the storage shelving plate 100 from deforming in use. The first convex rib 50 can have a structure similar to that described above, and will not be repeated again herein.

In the present embodiment, the storage shelving plate 100 can be made by method of injection molding, which can facilitate processing a plurality of clamping members 41. Injection molding can be used for processing discontinuous structures, and the processing technology is mature.

Referring to FIG. 14, the storage shelving system 200 of the present embodiment can further include a suspension member 400. The suspension member 400 can be detachably disposed on the net frame 220, and the suspension member 400 can be configured for hanging more objects, so that the storage shelving system 200 can be used in more workplaces.

Specifically, the suspension member 400 can include a curving portion 410, and a fifth groove 420 can be disposed on an end of the curving portion 410. Referring to FIG. 1, the storage shelving system 200 can further include an attached rod 450, which can be disposed in the fifth groove 420. It should be understood that, in order to prevent the attached rod 450 from separating from the fifth groove 420, an inner wall of the fifth groove 420 can be a little smaller than a diameter of the attached rod 450. Moreover, a length of a clamping arm of the clamping member 41 can be greater than the diameter of the middle rod 2214, thereby increasing the stability of the clamping.

In some embodiments, both sides of the curving portion 410 can be provided with the third convex rib 411 to increase the strength of the curving portion 410, so that the attached rod 450 can support objects having larger weight.

In some embodiments, the back surface 12 of the storage shelving plate 100 can be provided with a first reserved portion 122 configured for giving way to the suspension member 400. In the present embodiment, the first bending portion 21 and a first convex rib 50 (which is closest to the first bending portion 21) can define the first reserved portion 122.

A sixth groove 430 and a seventh groove 440 can be further disposed on the suspension member 400. The suspension member 400 can be detachably disposed on the net frame 220 via the sixth groove 430 and the seventh groove 440.

In some embodiments, an angle can be defined between an opening direction of the sixth groove 430 and an opening direction of the seventh groove 440. In the present disclosure, the opening direction of the sixth groove 430 can be approximately perpendicular to the opening direction of the seventh groove 440. The opening direction of the sixth groove 430 can be downwards, and the opening direction of the seventh groove 440 can be along a horizontal direction. This not only can limit the movement of the suspension member 400 along the vertical direction, but also can limit the movement of the suspension member 400 along the horizontal direction.

In the present embodiment, the attached rod 450 can be hollow to decrease a weight itself. In some embodiments, in order to improve mechanical strength of the attached rod 450, the attached rod 450 can be defined as a solid construction, or other supporting structures can be disposed in the attached rod 450, which is not limited herein.

Furthermore, both ends of the attached rod 450 can be provided with a second end cap 451, which can prevent the user from scratching by the end of the attached rod 450.

Furthermore, an outer diameter of the second end cap 451 can be larger than the outer diameter of the attached rod 450. The second end cap 451 can further prevent the attached rod 450 from separating from the fifth groove 420 along a length direction of the attached rod 450.

The storage shelving plate 100 can have a plurality of kinds of structures. The plurality of kinds of storage shelving plate 100 will be described hereinafter. The method for connecting the storage shelving plate 100 to the net frame 220 and/or the supporting frame 210 can be the same as that described above, and will not be repeated again herein.

Referring to FIG. 15 to FIG. 21, the plurality of kinds of storage shelving plates 100 are shown in FIG. 15 to FIG. 21. In these embodiments, all of the storage shelving plates 100 are disposed on the storage component 201 via matching between a first mounting member 20 and a second mounting member 30.

Referring to FIG. 15, a sixth embodiment provides a storage shelving plate 100, a first mounting member 20 of the storage shelving plate 100 including a first bending portion 21 and a third bending portion 22. The second mounting member 30 can include a second bending portion 31 and a second hook portion 33. In the present embodiment, a reserved groove 121 can be further disposed on a back surface 12 of the storage shelving plate 100, and the reserved groove 121 can be configured for giving place to a middle rod of the net frame 220. It should be understood that in other embodiments, a shape of the reserved groove 121 can be adjusted according to requirements, so that the reserved groove 121 can give place to rods in the first set of rods 221 and/or rods in the second set of rods 222, e.g., the reserved groove 121 in FIG. 10.

In the present embodiment, the shelving storage plate 100 can be molded by a method of extrusion molding. The processing technology is mature and the manufacturing cost is low.

Referring to FIG. 16, a seventh embodiment is provided a storage shelving plate 100, the first mounting member 20 of the storage shelving plate 100 can include a first bending portion 21 and a third bending portion 22, and a cross section of the first bending portion 21 can be U-shaped. The second mounting member 30 can include a second bending portion 31. In the present embodiment, a reserved groove 121 can further be disposed on a back surface of the storage shelving plate 100, which will not be repeated again herein. Furthermore, the back surface 12 of the storage shelving plate 100 in the present embodiment can further be provided with a second reserved portion 123. The second reserved portion 123 can be configured for giving way to the storage component 20 at the second side 203, so as to avoid influencing connection between the second mounting member 30 and the storage component 201.

In the present embodiment, the shelving storage plate 100 can be molded by a method of extrusion molding. The processing technology is mature and the manufacturing cost is low.

Figure 17:
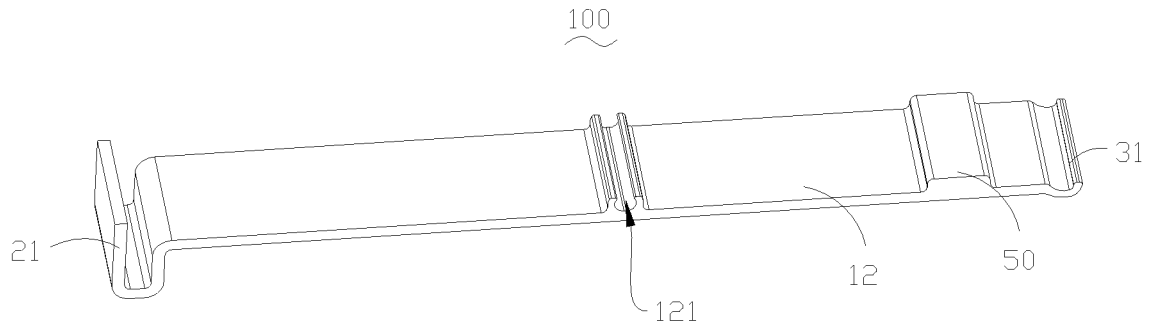
FIG. 17 is a structural schematic diagram of a storage shelving plate in an eighth embodiment of the present disclosure.

Referring to FIG. 17, an eighth embodiment provides a storage shelving plate 100, a first mounting member 20 of the storage shelving plate 100 can include a first bending portion 21, and a cross section of the first bending portion 21 can be U-shaped. The second mounting member 30 can include a second bending portion 31, and the second bending portion 31 can be arc-shaped. In the present embodiment, a reserved groove 121 can further be disposed on a back surface of the storage shelving plate 100, which will not be repeated herein. Furthermore, the back surface of the storage shelving plate 100 in the present embodiment can further be provided with a first convex rib 50. The first convex rib 50 can be configured for filling up a gap between the storage shelving plate 100 and the storage component 201, and can increase mechanical strength of the storage shelving plate 100, so as to improve supporting force of the storage shelving plate 100.

In the present embodiment, the shelving storage plate 100 can be molded by a method of extrusion molding. The processing technology is mature and the manufacturing cost is low.

Figure 18:
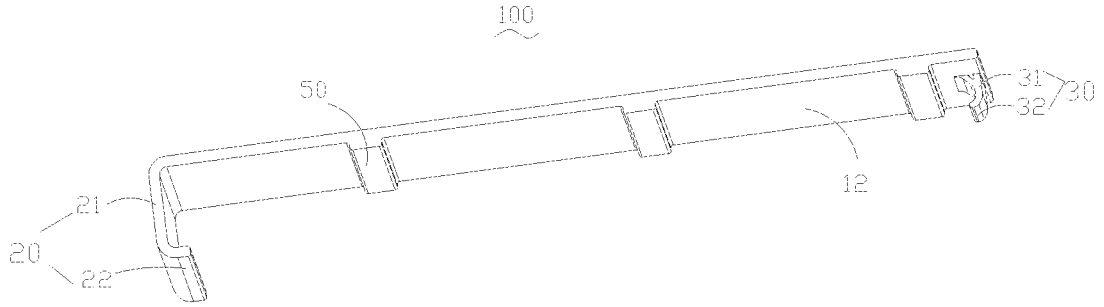
FIG. 18 is a structural schematic diagram of a storage shelving plate in a ninth embodiment of the present disclosure.

Referring to FIG. 18, a ninth embodiment provides a storage shelving plate 100, a first mounting member 20 of the storage shelving plate 100 can include a first bending portion 21 and a third bending portion 22. The storage shelving plate 100 can include a plurality of second mounting members 30, and each of the plurality of second mounting members 30 can include a second bending portion 31 and a fourth bending portion 32, wherein the fourth bending portion 32 can be arc-shaped. In the present embodiment, a back surface of the storage shelving plate 100 can further be provided with a first convex rib 50, which will not be repeated again herein.

In order to facilitate molding a plurality of second mounting members 30, the storage shelving plate 100 in the present embodiment can be made by injection molding. Injection molding can be used for processing discontinuous structures, and the processing technology is mature.

Figure 19:
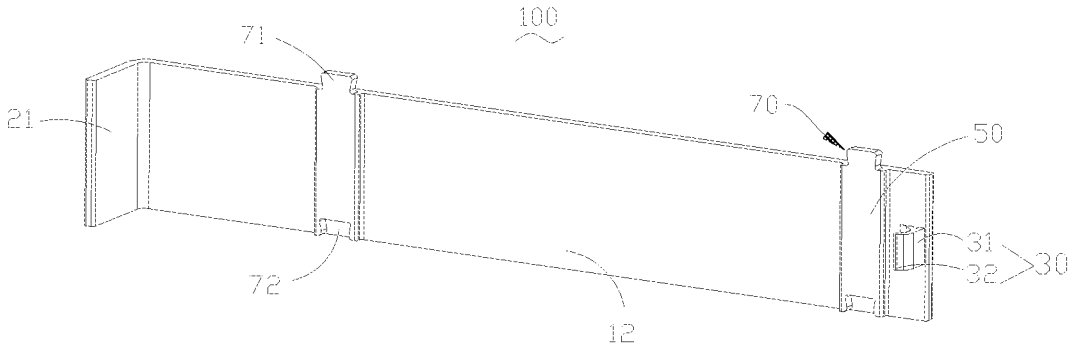
FIG. 19 is a structural schematic diagram of a storage shelving plate in a tenth embodiment of the present disclosure.

Referring to FIG. 19, a tenth embodiment is provided a storage shelving plate 100, a first mounting member 20 of the storage shelving plate 100 can include a first bending portion 21, and an angle defined between the first bending portion 21 and the plate body can be approximately a right angle. The storage shelving plate 100 can include a plurality of second mounting members 30, and each of the plurality of second mounting members 30 can include a second bending portion 31 and a fourth bending portion 32, wherein the fourth bending portion 32 can be arc-shaped. In the present embodiment, a back surface of the storage shelving plate 100 can further be provided with a first convex rib 50, which will not be repeated again herein.

Furthermore, in the present embodiment, the storage shelving plate 100 can be further provided with two conjunction portions 70. Adjacent two storage shelving plates 100 can be connected via two conjunction portions 70 to increase total length of the storage shelving plate 100. Furthermore, this can decrease processing difficulty of injection molding, and avoid deformation caused while processing a large thin plate by injection molding. Moreover, a size of each of the storage shelving plate 100 can be smaller, so that a volume of transportation packaging, production cost and storage cost can also be reduced.

In some embodiments, the conjunction portion 70 can include a tenon portion 71 and a blind mortise portion 72 matching with each other. The tenon portion 71 and the blind mortise portion 72 can be disposed at two side of the storage shelving plate 100, respectively. The tenon portion 71 can be clamped in the blind mortise portion 72, resulting in forming a fixed connection.

Furthermore, the tenon portion 71 can be approximately trapezoid-shaped. A groove of the blind mortise portion 72 can be approximately trapezoid-shaped to avoid forming a gap between two adjacent storage shelving plates 100.

Furthermore, in the present embodiment, both the tenon portion 71 and the blind mortise portion 72 can be disposed on the first convex rib 50, so as to provide a more compact structure to the storage shelving plate 100.

For facilitating molding the tenon portion 71 and the blind mortise portion 72, the storage shelving plate 100 in the present embodiment can be made by injection molding. Injection molding can be used for processing discontinuous structures, and the processing technology is mature.

Figure 20:
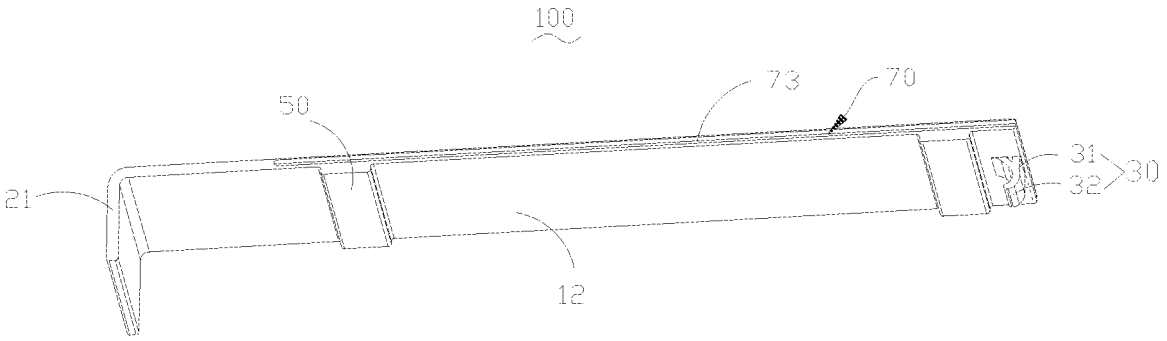
FIG. 20 is a structural schematic diagram of a storage shelving plate in an eleventh embodiment of the present disclosure.
Figure 21:
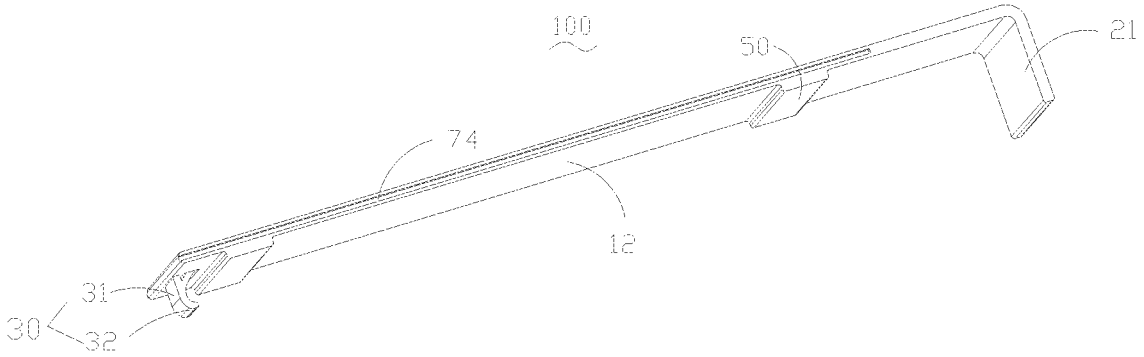
FIG. 21 is a structural schematic diagram of the storage shelving plate in FIG. 10 from another angle.

Referring to FIG. 20 to FIG. 21, an eleventh embodiment provides a storage shelving plate 100, a first mounting member 20 of the storage shelving plate 100 can include the first bending portion 21. An angle between the first bending portion 21 and the plate body can be approximately a right angle. The storage shelving plate 100 can include a plurality of second mounting members 30, and each of the plurality of second mounting members 30 can include a second bending portion 31 and a fourth bending portion 32, wherein the fourth bending portion 32 can be arc-shaped. In the present embodiment, a back surface of the storage shelving plate 100 can further be provided with a first convex rib 50, which will not be repeated again herein. Furthermore, in the present embodiment, the storage shelving plate 100 can further be provided with a conjunction portion 70. The conjunction portion 70 can play a similar role as the conjunction portion in the tenth embodiment. Compared with the tenth embodiment, the specific structure of the conjunction portion 70 in the present embodiment is different. In the present embodiment, a first slideway 73 and a second slideway 74 can be provided at both sides of the storage shelving plate 100, respectively. The two adjacent storage shelving plates 100 can be connected via matching between the first slideway 73 and the second slideway 74.

In some embodiments, in the present disclosure, the first slideway 73 can protrude from a broadside of the storage shelving plate 100, and the second slideway 74 can dent in the broadside of the storage shelving plate 100. It should be understood that in other embodiments, the first slideway 73 and the second slideway 74 can have other shapes, as long as they can clamp to each other.

For facilitating the molding process of the first slideway 73, the second slideway 74 and the plurality of the second mounting members 30, the storage shelving plate 100 in the present embodiment can be made by injection molding. Injection molding can be used for processing discontinuous structures, and the processing technology is mature.

Figure 22:
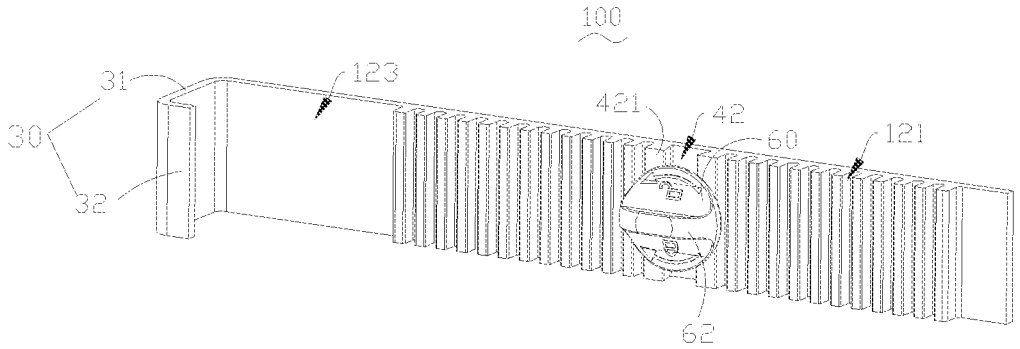
FIG. 22 is a structural schematic diagram of a storage shelving plate in the twelfth embodiment of the present disclosure.
Figure 23:
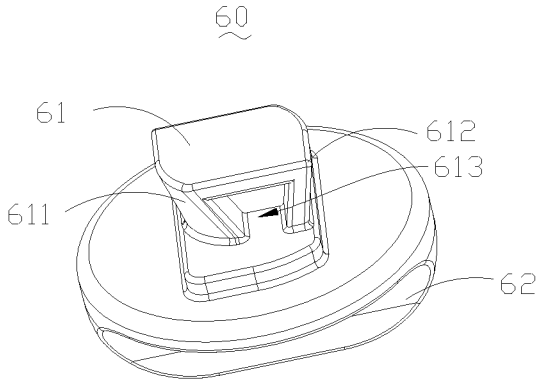
FIG. 23 is a structural schematic diagram of the fixing member in FIG. 22.
Figure 24:
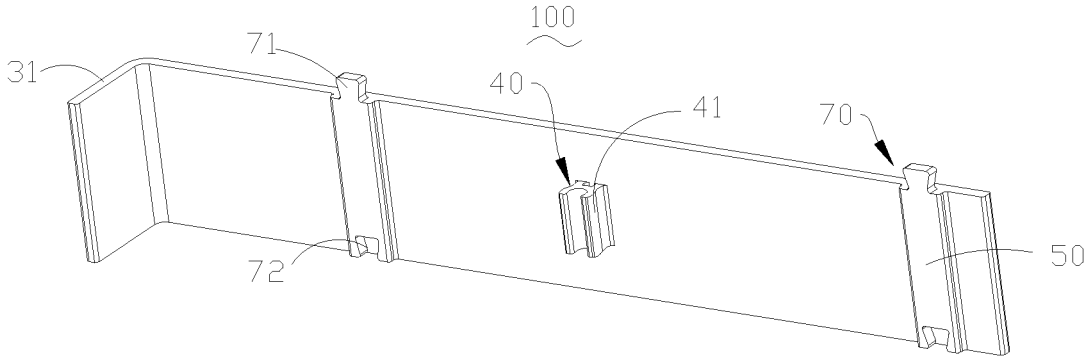
FIG. 24 is a structural schematic diagram of a storage shelving plate in the thirteenth embodiment of the present disclosure.

Referring to FIG. 22 to FIG. 24, two kinds of the storage shelving plates 100 are shown in FIG. 22 to FIG. 24. In the two embodiments, both kinds of the storage shelving plates 100 can be disposed on a storage component 201 via a third mounting member 40.

Referring to FIG. 22 and FIG. 23, a twelfth embodiment is provided a storage shelving system 200, the storage shelving system 200 can further include a fixing member 60, which can be detachably disposed on the third mounting member 40. Moreover, the fixing member 60 can be configured for disposing the storage shelving plate 100 on the net frame 220.

Specifically, the third mounting member 40 can include a locating member 42. A mounting groove 421 can be disposed on the locating member 42. The fixing member 60 can include a fixing portion 61. The fixing portion 61 can include a rotating curved surface 611 and a stopper 612. The fixing portion 61 can rotate in the mounting groove 421 via the rotating curved surface 611 and limit a rotation angle of the fixing portion via the stopper, resulting in the fixing portion 61 being disposed in the mounting groove 421. Therefore, a connection between the storage shelving plate 100 and the net frame 220 can be relatively stable, facilitating molding the storage shelving plate 100.

In some embodiments, the mounting groove 421 can be a trapezoid-shaped groove, and an inner diameter of the mounting groove 421 can gradually increase along a direction towards the net frame 220. The fixing portion 61 can include two rotating curved surfaces 611 and two stoppers 612, and the two rotating curved surfaces and the two stopper are staggered disposed. The two rotating curved surfaces 611 can be able to contact simultaneously with or separate simultaneously from an inner wall of the mounting groove 421, and the two stoppers 612 can be able to contact simultaneously with or separate simultaneously from the inner wall of the mounting groove 421. It should be understood that a number of the rotating curved surface 611 and a number of the stopper 612 in the present embodiment are not limited. The numbers of the rotating curved surface 611 and stopper 612 can further be one, three or more, as long as they can work.

In order to ensure the stability of connection between the storage shelving plate 100 and the net frame 220, the fixing portion 61 can form an interference between the fixing portion 61 and the mounting groove 421.

In some embodiments, a first groove 613 can be disposed on the fixing portion 61, and a periphery wall of the first groove 613 can define a rotating curved surface 611 and a stopper 612. Therefore, the fixing portion 61 can slightly deform via the first groove 613, and this can facilitate forming the interference fit between the fixing portion 61 and the mounting groove 421.

Furthermore, the fixing portion 61 can further include a swirling portion 62. The swirling portion 62 can drive the fixing portion 61 to rotate. The swirling portion 62 can facilitate using the fixing member 60. In some embodiments, the swirling portion 62 can be provided with a rotating symbol, so that the user can distinguish a direction to screw up and screw off.

After the storage shelving plate 100 is disposed on the net frame 220, in order to improve the stability, the back surface 12 of the storage shelving plate 100 can be provided with a plurality of reserved grooves 121. A first rod and/or a second rod can be accommodated in the reserved groove 121, and this can prevent the storage shelving plate 100 from moving by a large margin along a width or a length of the storage shelving plate 100.

Furthermore, in the present disclosure, the storage shelving plate 100 can further include a first mounting member 20. The first mounting member 20 can include the first bending portion 21 and the third bending portion 22. An angle between the first bending portion 21 and the storage shelving plate 100 can be approximately a right angle. An angle between the third bending portion 22 and the first bending portion 21 can be approximately a right angle. The first bending portion 21 can play a role similar to the first bending portion 21 in the fifth embodiment, the third bending portion 22 can play a role similar to that above, and will not be repeated again herein.

Referring to FIG. 24, a thirteenth embodiment provides a plurality of storage shelving plates 100 being connected via a plurality of conjunction portions 70. A back surface 12 of the storage shelving plate 100 can be provided with a clamping member 41, defining a third mounting member 40. The clamping member 41 can elastically clamp a middle rod 2214 of a first set of rods 221.

Wherein, the conjunction portion 70 can include a tenon portion 71 and a blind mortise portion 72. The conjunction portion 70 can be disposed on the first convex rib 50 and play a similar role as that in the tenth embodiment, which will not be described in details hereinafter.

In the present embodiment, the storage shelving plate 100 can further be provided with a first mounting member 20. The first mounting member 20 can be a first bending plane. The first bending plane and the plate body can approximately define a right angle. The first bending portion plays a similar role as that in the fifth embodiment and will not be described in details hereinafter.

In order to facilitate processing and molding of the clamping member 41, the storage shelving plate 100 in this embodiment can be made by injection molding. Injection molding can be used for processing discontinuous structures, and the processing technology is mature.

The present disclosure provides a storage shelving plate 100 and a storage shelving system 200. The storage shelving plate 100 can have successively disposed supporting surfaces 11, which not only can be configured for disposing small objects, but also can prevent metal spines of the net frame 220 from scratching a user. Moreover, the storage shelving plate 100 can also match with a conventional net frame and a supporting frame, and be widely used.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A storage shelving system, comprising a storage component which comprises a supporting frame and a net frame disposed on the supporting frame, and a storage shelving plate comprising a mounting member, and the storage shelving plate is able to be disposed on the storage component via the mounting member;

the storage shelving plate has a first side and a second side separated from each other, the mounting member comprises a first mounting member at the first side of the storage shelving plate and a second mounting member at the second side of the storage shelving plate, the storage shelving plate is disposed on the storage component via the first mounting member and the second mounting member;

the first mounting member and the second mounting member abut against the first side and the second side of the storage shelving plate, respectively, the storage shelving plate fits onto the storage component via a clamping force that is defined between the first mounting member and the storage shelving plate and between the second mounting member and the storage shelving plate;

the storage shelving plate comprises a plate body, the first mounting member is located at the plate body, a first preset angle is defined between the first mounting member and the plate body, and the first mounting member elastically abuts against the storage component;

the second mounting member is located at the plate body, a second preset angle is defined between the second mounting member and the plate body, and the second mounting member elastically abuts against the storage component;

the first mounting member comprises a first bending portion fixed to the plate body; the first bending portion elastically abuts against the storage component;

the second mounting member comprises a second bending portion and a second hook portion, the second bending portion is fixed to the plate body, the second hook portion protrudes from the second bending portion and towards the first side of the storage shelving plate, and the second hook portion is configured for preventing the second mounting member from separating from the supporting frame;

a first hook portion is fixed to the supporting frame and adjacent to the second side of the storage shelving plate, and the first hook portion extends away from the first side of the storage shelving plate; the second mounting member is elastic, and the second mounting member abuts against the first hook portion via the second hook portion.

2. The storage shelving system of claim 1, wherein the first mounting member further comprises a third bending portion, which is fixed to the first bending portion and bends towards the second side of the storage shelving plate, and the third bending portion is configured for preventing the first mounting member from separating from the storage component.

3. The storage shelving system of claim 1, wherein the mounting member comprises a plurality of second mounting members, and the plurality of second mounting members abut against the net frame, respectively.

4. The storage shelving system of claim 1, wherein the net frame comprises a first set of rods and a second set of rods, the first set of rods and the second set of rods form a net-shaped structure; the storage shelving plate comprises a third mounting member, the storage shelving plate is disposed to the net frame via matching between the third mounting member and the first set of rods and matching between the third mounting member and the second set of rods.

5. The storage shelving system of claim 2, wherein the first bending portion bends relative to the plate body and is integrally formed with the plate body, the first preset angle is an acute angle.

6. The storage shelving system of claim 2, wherein the net frame has a loading plane, the net frame bends at one side of the loading plane to form a laterally bending plane, and at least a part of the laterally bending plane abuts against the first bending portion, and the second bending portion is configured for preventing the storage shelving plate from separating from the net frame.

7. The storage shelving system of claim 4, wherein the third mounting member comprises a plurality of elastic clamping members which are configured for clamping the first set of rods and the second set of rods, so that the storage shelving plate is disposed to the net frame.

* * * * *